US006653982B2

(12) United States Patent
Lindenmeier et al.

(10) Patent No.: US 6,653,982 B2
(45) Date of Patent: Nov. 25, 2003

(54) FLAT ANTENNA FOR MOBILE SATELLITE COMMUNICATION

(75) Inventors: Heinz Lindenmeier, Planegg (DE); Leopold Reiter, Gilching (DE); Jochen Hopf, Haar (DE)

(73) Assignee: FUBA Automotive GmbH & Co. KG, Bad Salzdetfurth (DE)

( * ) Notice: Subject to any disclaimer, the term of this patent is extended or adjusted under 35 U.S.C. 154(b) by 0 days.

(21) Appl. No.: 10/082,719

(22) Filed: Feb. 22, 2002

(65) Prior Publication Data

US 2002/0118138 A1 Aug. 29, 2002

(30) Foreign Application Priority Data

Feb. 23, 2001 (DE) ..... 101 08 910
Dec. 22, 2001 (DE) ..... 101 63 793

(51) Int. Cl.[7] ..... H01Q 11/12
(52) U.S. Cl. ..... 343/741; 343/866; 343/797; 343/853
(58) Field of Search ..... 343/741, 742, 343/745, 749, 750, 751, 797, 866, 867, 853

(56) References Cited

U.S. PATENT DOCUMENTS

| | | | | |
|---|---|---|---|---|
| 2,994,876 A | | 8/1961 | Josephson | |
| 3,427,624 A | | 2/1969 | Wanselow et al. | |
| 3,604,007 A | * | 9/1971 | Solby | 343/720 |
| 5,173,715 A | | 12/1992 | Rodal et al. | 343/795 |
| 5,442,368 A | * | 8/1995 | Harada et al. | 343/713 |
| 5,457,470 A | * | 10/1995 | Hai et al. | 343/828 |
| 5,629,712 A | * | 5/1997 | Adrian et al. | 343/713 |
| 5,654,724 A | * | 8/1997 | Chu | 343/742 |
| 5,784,032 A | | 7/1998 | Johnston et al. | 343/702 |
| 6,014,107 A | * | 1/2000 | Wiesenfarth | 343/742 |
| 6,181,298 B1 | | 1/2001 | Strickland | 343/895 |
| 6,480,158 B2 | * | 11/2002 | Apostolos | 343/700 MS |
| 6,522,302 B1 | * | 2/2003 | Iwasaki | 343/726 |

FOREIGN PATENT DOCUMENTS

| | | |
|---|---|---|
| DE | 40 08 505 | 9/1991 |
| EP | 0 952 625 | 4/1999 |
| WO | 00 24085 | 4/2000 |

OTHER PUBLICATIONS

IEEE "Transactions on Antennas and Propagation", 1976, pp. 349–351, (Enclosed).

* cited by examiner

*Primary Examiner*—Tan Ho
(74) *Attorney, Agent, or Firm*—Collard & Roe, P.C.

(57) ABSTRACT

An antenna for mobile satellite communication disposed on a substantially horizontally oriented conductive base surface having substantially linear conductor parts and an antenna connection point. The conductor parts have a substantially vertical extension portion, substantially horizontal extension portion which, together with the conductive base surface, form a high frequency conducting ring structure. The conductor parts are disposed in a plane, mounted perpendicular to the conductive base surface, and one of the vertical or horizontal extension portions is interrupted to form the antenna connection point. In a further interruption of one of the conductor parts, is provided at least one impedance connection point wired to an impedance. The positions of the impedance connection point and of the antenna connection point as well as the impedance are chosen so that, for the plane standing perpendicular to the conductive base surface, with waves polarized in this plane, the predetermined antenna gain values can be obtained for a predetermined elevation angle of the incident wave.

37 Claims, 22 Drawing Sheets

FLAT ANTENNA FOR MOBILE SATELLITE COMMUNICATION

BACKGROUND

This invention relates to an antenna for mobile satellite communication on a substantially horizontally oriented conductive base surface having substantially linear conductor parts, and an antenna connection point. Antennas of this type are known from German Patent 4,008,505.8. This antenna has crossed horizontal dipoles with dipole halves which are inclined downward in the form of a vee. It also has linear conductor parts, and the dipoles are mechanically fixed to one another at an angle of 90 degrees. They are attached at the upper end of a linear vertical conductor, fastened on a horizontally oriented conductive base surface.

To generate the circular polarization usually needed in satellite communications, the two horizontal dipoles, inclined downwardly in the form of a vee are electrically interconnected via a 90 degree phase network. Depending on satellite communications system, a steady antenna gain of 3 dBi for circular polarization is strictly required for satellite antennas in the elevation angle range of between 25 or 30 degrees, and 90 degrees. With antennas of this design, the antenna gain required in the region of the zenith angle can generally be achieved without problems. In contrast, the required antenna gain in the region of low elevation angles of 20 to 30 degrees can be achieved only with difficulty. Because the horizontal dipoles are inclined downwardly in the form of a vee, and require a sufficiently large distance from the conductive base surface in order to function, the required antenna gain cannot be obtained with a very low overall height of the antennas, as would be necessary for mobile service.

It is further known that curved antennas can be used to satisfy the gain requirements both in the angle range of low elevation, and in the case of high-angle radiation from linear conductors. The antenna form used frequently today is the quadrifilar helix antenna according to Kilgus (IEEE Transactions on Antennas and Propagation, 1976, pp. 238–241). These antennas often have a length of several wavelengths, and are not known as flat antennas with a low overall height. Even with an antenna of low overall height specified in European Patent 0952625 A2, the aforesaid gain values in the angle range of low elevation cannot be achieved.

SUMMARY

An object of the invention is to provide an antenna which ensures that the ratio of antenna gain in the low elevation region to antenna gain in the zenith angle region can be adjusted as required in an azimuthal main plane, so that by combination of a plurality of these antennas, a directional diagram having the gain requirements for satellite communication with circularly polarized waves can be constructed, and the antenna has an electrically small overall height.

Antennas according to the invention can be made particularly simply and thus inexpensively, especially in their embodiment for satellite communications. Furthermore, by virtue of the fact that they are constructed above a conductive base surface, and that they can be configured with a low overall height, they are suitable particularly for service on vehicles. A further advantage is that they can be expanded to combination antennas for terrestrial communication, and this design provides a savings in overall space on motor vehicles. A further advantage is that measures can be taken to ensure that, in the event of any discontinuities that may be present in the conductive base surface or in the inclination thereof relative to the horizontal, which can occur due to the pitch or edge of a roof, the resulting perturbation of the directional diagram can be largely compensated.

BRIEF DESCRIPTION OF THE DRAWINGS

Other objects and features of the present invention will become apparent from the following detailed description considered in connection with the accompanying drawings which disclose the many embodiments of the invention. It should be understood, however, that the drawings are designed for the purpose of illustration only, and not as a definition of the limits of the invention.

In the drawings, wherein similar reference characters denote similar elements throughout the several views.

DESCRIPTION

Figure 1:
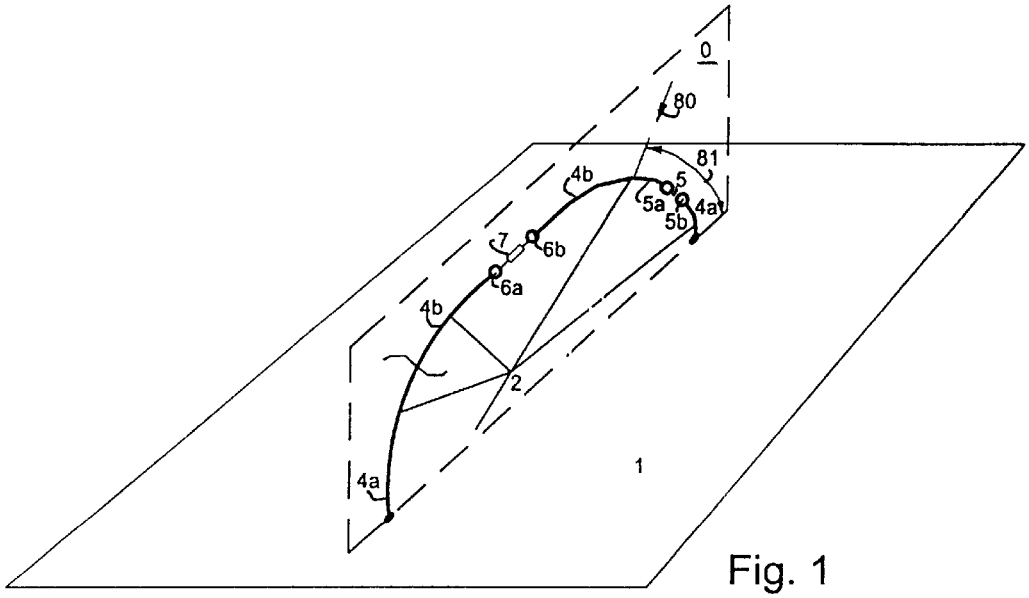
FIG. 1 shows the principle of an antenna according to the invention with a high-frequency-conducting ring structure, having substantially vertical and horizontal conductor parts, and a conductive base plane.

FIG. 1 shows the basic form of an antenna according to the invention having a high frequency conducting ring structure 2 formed together with conductive base surface 1, and provided with conductor parts having a substantially horizontal extension 4*b*, and conductor parts having a substantially vertical extension 4*a*, disposed within a plane 0 standing perpendicular to conductive base surface 1. A function that is essential according to the present invention is performed by an impedance 7, which is mounted at an interruption point of high-frequency-conducting ring structure 2 in an impedance connection point 6, having a first impedance terminal 6*a* and second impedance terminal 6*b*. During incidence of an electromagnetic wave polarized in plane 0, at a certain elevation angle 81, horizontal electrical field components are recorded mainly by the conductor parts having a substantially horizontal extension 4*b* and, corresponding hereto, the vertical electrical field components are recorded mainly by the conductor parts having a substantially vertical extension 4*a*. If antenna connection point 5 is appropriately positioned at an interruption point of ring structure 2, and impedance 7 is appropriately positioned inside ring structure 2, a vertical antenna diagram with a desired overlap of the recording of vertical and horizontal electrical field components can be established.

Figure 2:
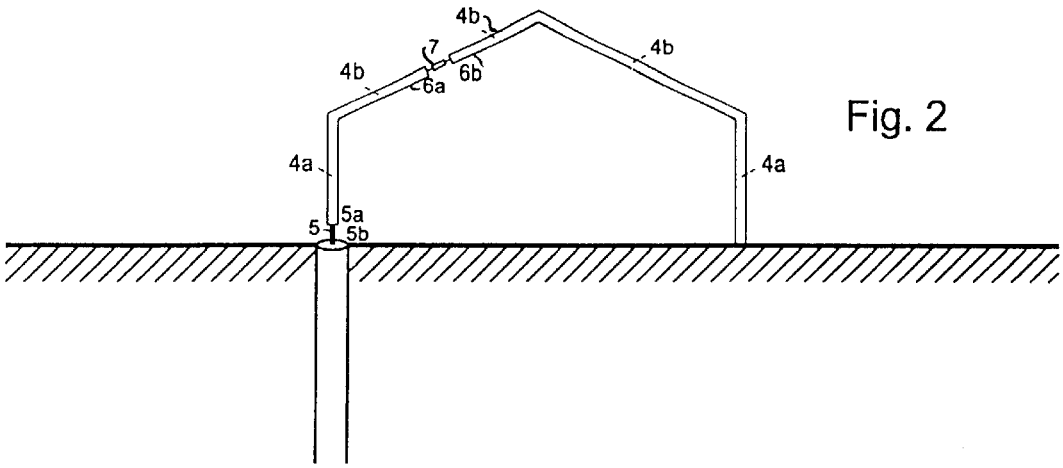
FIG. 2 shows the principle of an antenna according to the invention with a unilateral coupling at an antenna connection point.

Control of the aforesaid ratio of antenna gain in the zenith angle region to the antenna gain in the region of low elevation angle is the basic requirement of antennas for satellite communication. Consequently, the ability to adjust vertical and horizontal reception is the basis of the present invention. In the embodiment of FIG. 2, antenna connection point 5 is formed on conductive base surface 1, and the antenna signals are coupled out of ring structure 2 between a first antenna terminal 5*a* and a second antenna terminal 5*b*. Thus, with the design of this antenna connection point 5, coupling to asymmetric lines can be achieved.

Figure 3A:
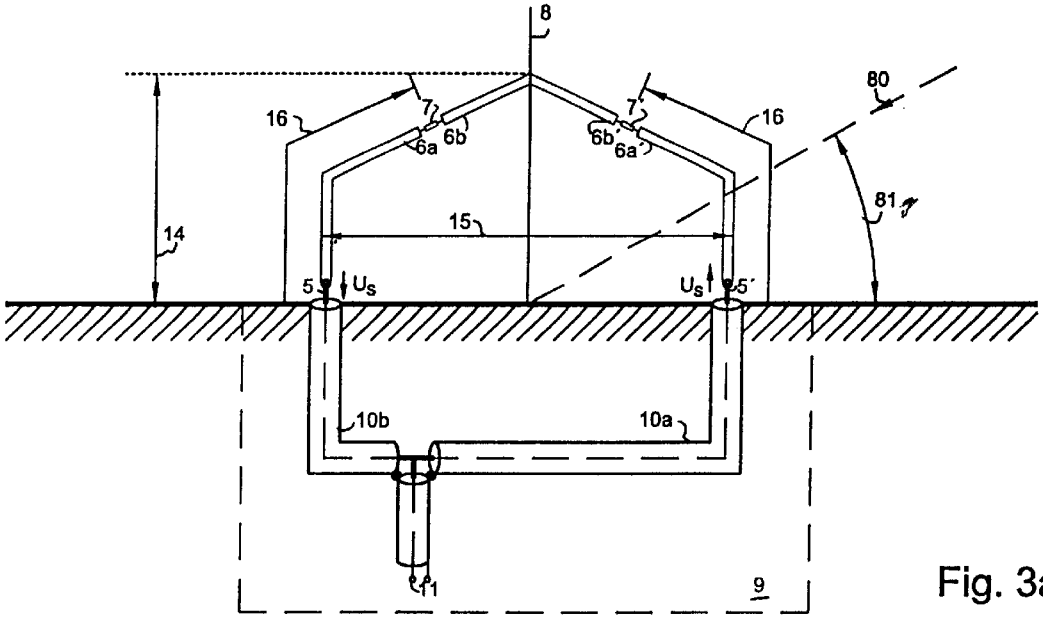
FIG. 3*a* shows a symmetrical antenna according to the invention with an asymmetrizing network.
Figure 3B:
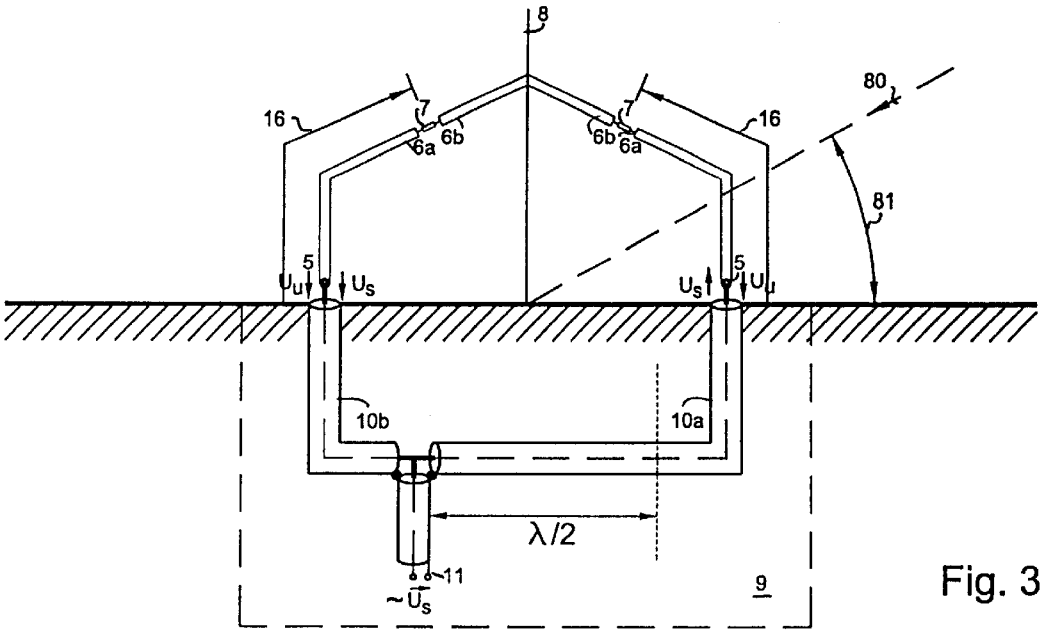
FIG. 3*b* shows a symmetrical antenna according to the invention with an asymmetrizing network, formed from asymmetric lines, whose length differs by an odd multiple of half the operating wavelength.

FIG. 3*a* shows a further embodiment of the invention, wherein ring structure 2 is designed to be symmetrical with respect to a vertical symmetry line 8. The antenna therefore contains two identical impedances 7 and 7', which are also positioned symmetrically with respect to vertical symmetry line 8. On conductive base surface 1, an antenna connection point 5' is mounted in a mirror image position relative to first antenna connection point 5. Coupling of ring structure 2 to conductive base surface 1 permits, as shown in FIG. 3*b*, the advantageous embodiment of an asymmetrical network 9, which can be constructed, for example, by means of a $\lambda/2$ phasing line for the signals. The asymmetrical received voltages Uu, which are formed symmetrically with respect to conductive base surface 1, and whose direction is indicated by arrows in the figures, are coupled out by simply connecting in parallel the asymmetrically indicated lines in FIG. 3*b*, whose lengths differ by $\lambda/2$. The combined symmetrical received voltage ~Us is available at an output collection point 11 in FIG. 3*b*.

This asymmetrizing network 9 can be constructed very advantageously and inexpensively as printed micro-stripline circuitry. With this arrangement, the vertical diagrams shown in FIG. 11 can be established in plane 0 using different configurations of impedance 7. The positioning of impedance 7 in ring structure 2 can be chosen as desired within broad limits. Here, a straight conductor length is particularly favorable for $\lambda/4$ portion 16 indicated in FIGS. 3*a* and 3*b*. This is true for the antenna impedances which are effective at antenna connection points 5, and which are suitable for an asymmetrizing network 9 that can be easily constructed by line circuits. In contrast, the matching vertical diagram can be established over broad limits, for various lengths of conductor portion 16 by an appropriate choice of impedance 7. For a preferred cross dimension 15 of somewhat less than one half wavelength, the directional diagrams illustrated in FIG. 11 can be achieved with an overall height 14 of less than one quarter wavelength.

Figure 11:
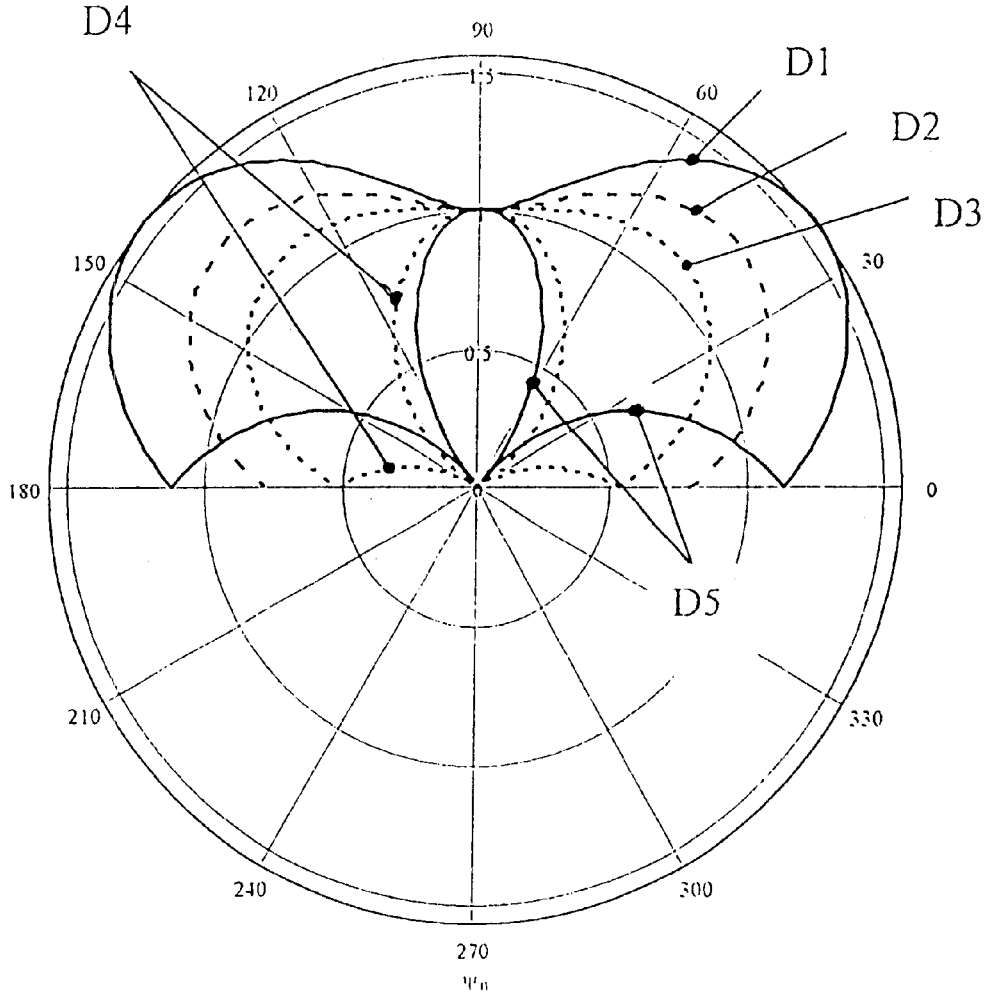
FIG. 11 shows a variation of the directional diagram for change of value and type (inductive or capacitive) of an impedance in an example of an inventive antenna.

In order to overcome the disadvantage of prior art satellite communications antennas, it is necessary to enhance the radiation in the region of low elevation angles by comparison with the radiation in the zenith angle region. This is achieved according to the invention by configuring impedance 7 as a capacitor. As a result, the enhancement of the radiation in the region of low elevation angle takes place with increasing reactance, or in other words with decreasing capacitance. This advantage is illustrated for decreasing capacitances by diagrams D3, D2 and D1 in FIG. 11. If impedance 7 is constructed as an inductor instead of a capacitor, the elevation diagrams designated D4 and D5 in FIG. 11 are obtained. These have the property of largely masking out an angle region at medium elevation. In this case a larger inductance value is chosen for directional diagram D5 than for directional diagram D4. Because of the requirement described above, capacitors are thus used as impedance 7 for satellite communications in an antenna according to the invention, aside from special cases for special applications. This property of the antenna is essential in order to combine a plurality of these antennas as a circularly polarized satellite communications antenna.

Figure 3C:
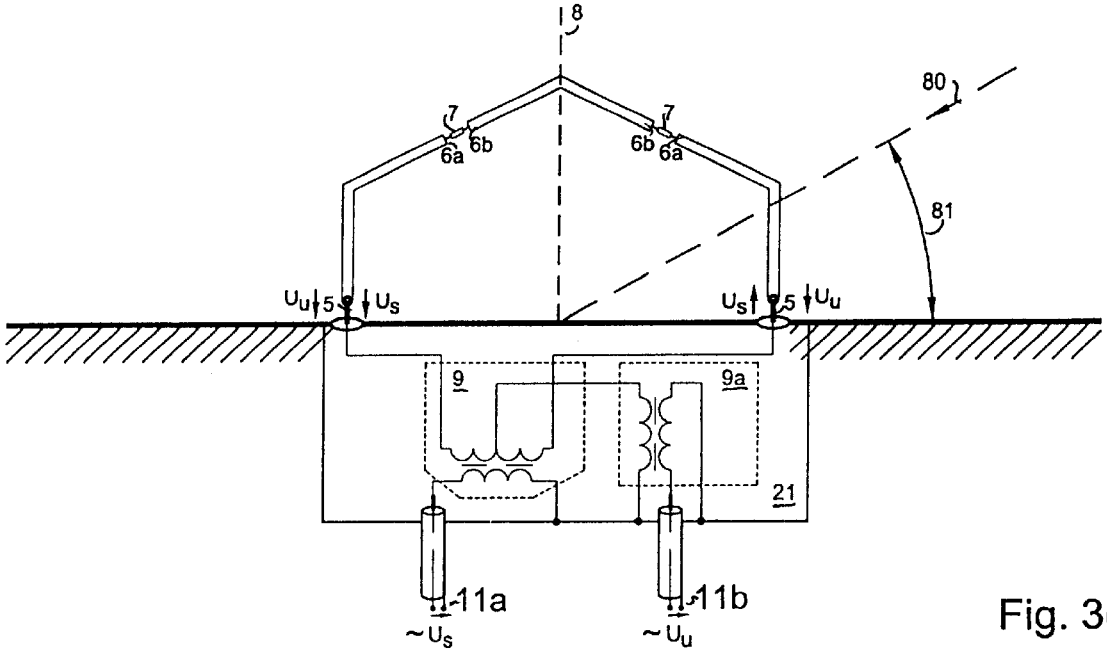
FIG. 3*c* shows a symmetric antenna according to the invention with an asymmetric network for separate asymmetric coupling from the symmetric and asymmetric voltages.

An advantage exists due to additional availability of the asymmetric voltages Uu at antenna connection points 5. This is exploited in FIG. 3*c* by the fact that a power divider 21 for coupling out the symmetric received voltages Us is present in a summation circuit 19 (shown later), in addition to an asymmetrizing network 9 for coupling out the asymmetric received voltages Uu. Thus both asymmetric received voltages Uu and symmetric received voltages Us can be coupled out separately from one another at collection point 11*a* for symmetric voltages and at collection point 11*b* for asymmetric voltages in FIG. 3*c*.

Figure 4A:
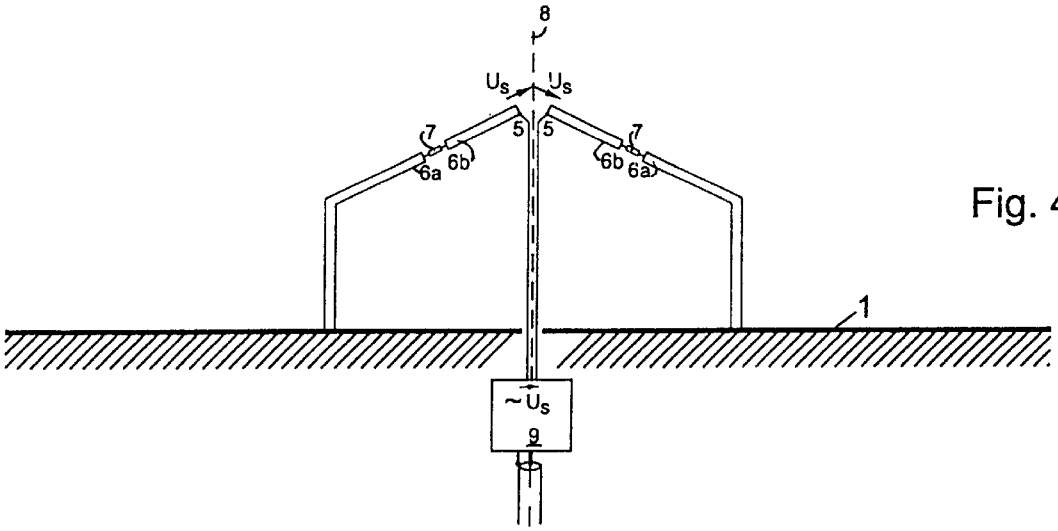
FIG. 4*a* shows a symmetric antenna according to the invention, in which the antenna connection point is disposed in the region of a symmetry axis of the antenna, and in which the signals are routed downward by means of a symmetric two-wire line.
Figure 4B:
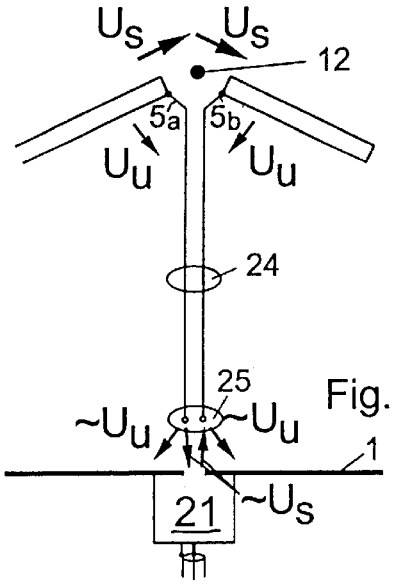
FIG. 4*b* shows a detail from FIG. 4*a*.

Further advantageous coupling out of the symmetric voltage Us can be achieved, as in FIG. 4*a*, at an antenna connection point 5 disposed in vertical symmetry line 8. For this purpose, as shown in FIG. 4*b* (detail of FIG. 4*a*), a two-wire line 24 is connected to first antenna terminal 5*a* and to second antenna terminal 5*b* and routed in vertical symmetry line 8 to conductive base surface 1, in the vicinity of which there is configured a line connection point 25. At this point there are formed, between the end points of two-wire line 24, the voltage ~Us proportional to the symmetrically received voltages Us and, between a respective end point of two-wire line 24 and conductive base surface 1, the voltage ~Uu proportional to the asymmetrically received voltages Uu.

Figure 4C:
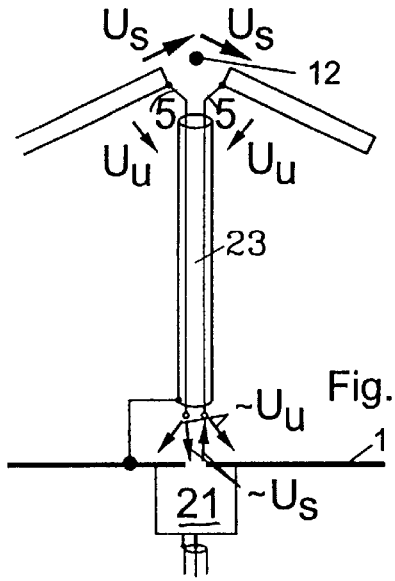
FIG. 4*c* shows a detail from FIG. 4*a*, but with a shielded two-wire line.
Figure 4D:
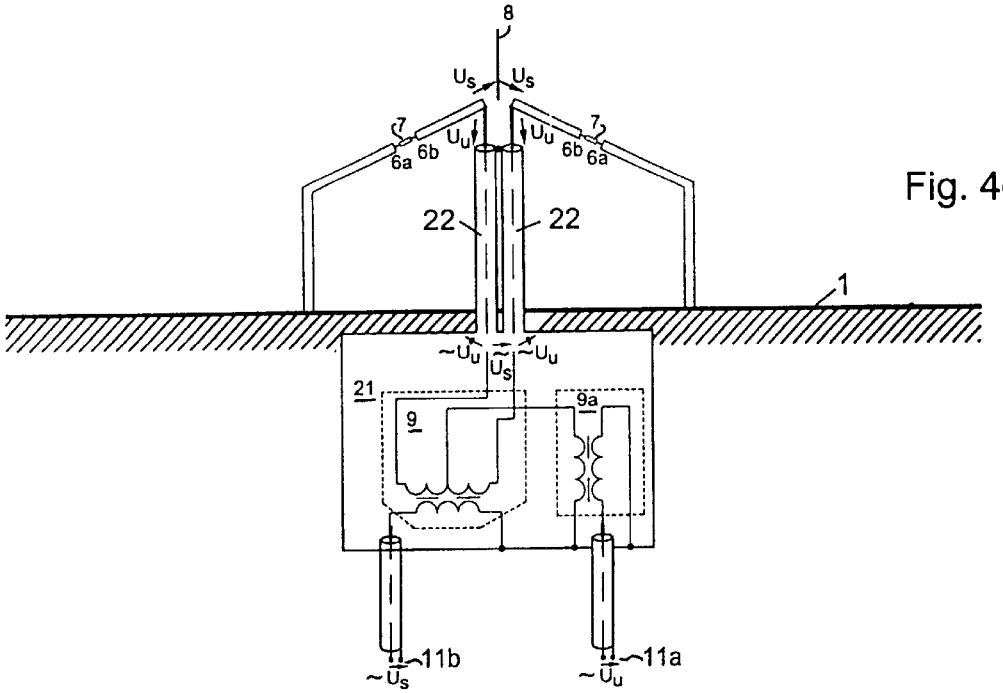
FIG. 4*d* shows an antenna according to the invention, similar to FIG. 4*a*, but with two coaxial lines instead of the two-wire line, and with an asymmetrizing network for separate asymmetric coupling from the symmetric and asymmetric voltages.

FIG. 4*c* shows a further advantageous embodiment of the invention, wherein two-wire line 24 can be replaced by a shielded two-wire line 23, whose shielding conductor is connected to conductive base surface 1. Here, a more favorable coupling out of the voltage ~Uu at conductive base surface 1 is possible. FIG. 4*d* shows a further favorable embodiment, wherein shielded two-wire line 23 can be constructed of two coaxial lines 22 routed in parallel, whose shields are connected to conductive base surface 1. By means of power divider 21, the voltages ~Us and ~Uu can be coupled out separately, as described above, with the arrangements of FIGS. 4*b*, 4*c* and 4*d*.

Figure 5:
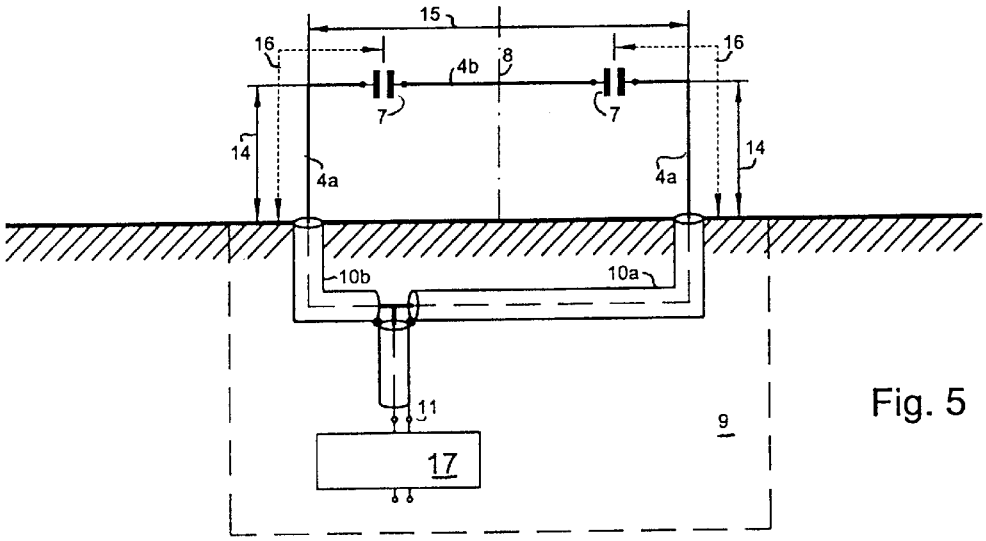
FIG. 5 shows an antenna according to the invention with dimensional data and with a matching network 17.

FIG. 5 shows an inventive antenna that is simple to make, with a ring structure 2 which has substantially rectangular shape. It was found that antennas with a portion 16 of about ¼ λ, a cross dimension 15 of about ⅓ λ, and an overall height 14 of about ⅙ λ have yielded sufficiently low losses in the required directional diagrams. A constructed inventive antenna for frequencies of around 2.3 GHz has, for example, an overall height 14 of only 2 cm, and a cross dimension 15 of 4.5 cm. In the case of smaller overall height, the requirements imposed on the directional diagram can be satisfied by choosing an appropriate capacitance for impedance 7, although increasing losses must be tolerated. Thus the losses occurring in matching circuit 17 connected downstream, increase with smaller antenna height.

Figure 6A:
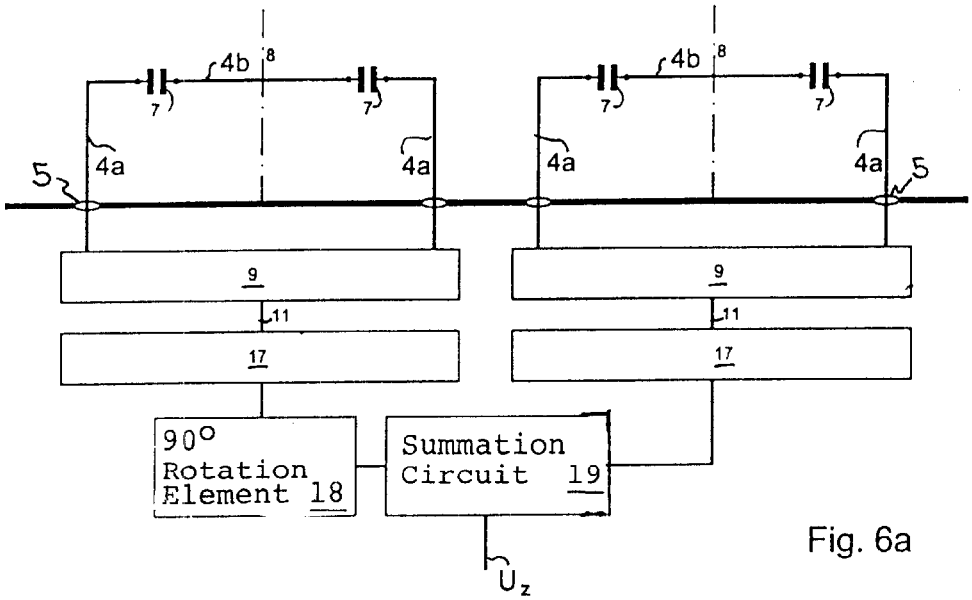
FIG. 6*a* shows an antenna for circular polarization, formed from two antennas according to the invention in orthogonal planes, the output signals of the antennas being combined via a 90 degree phase-rotation element in a summation circuit.
Figure 6B:
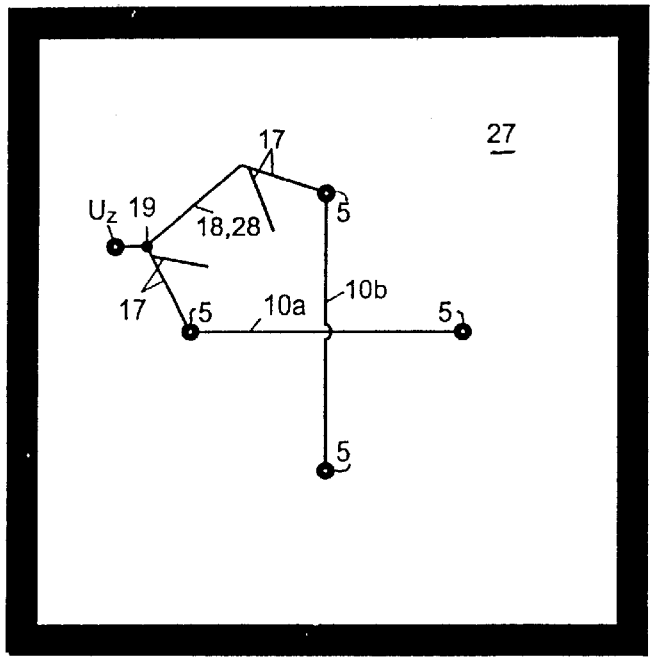
FIG. 6*b* shows an example of a stripline layout for the antenna according to FIG. 6*a*.
Figure 6C:
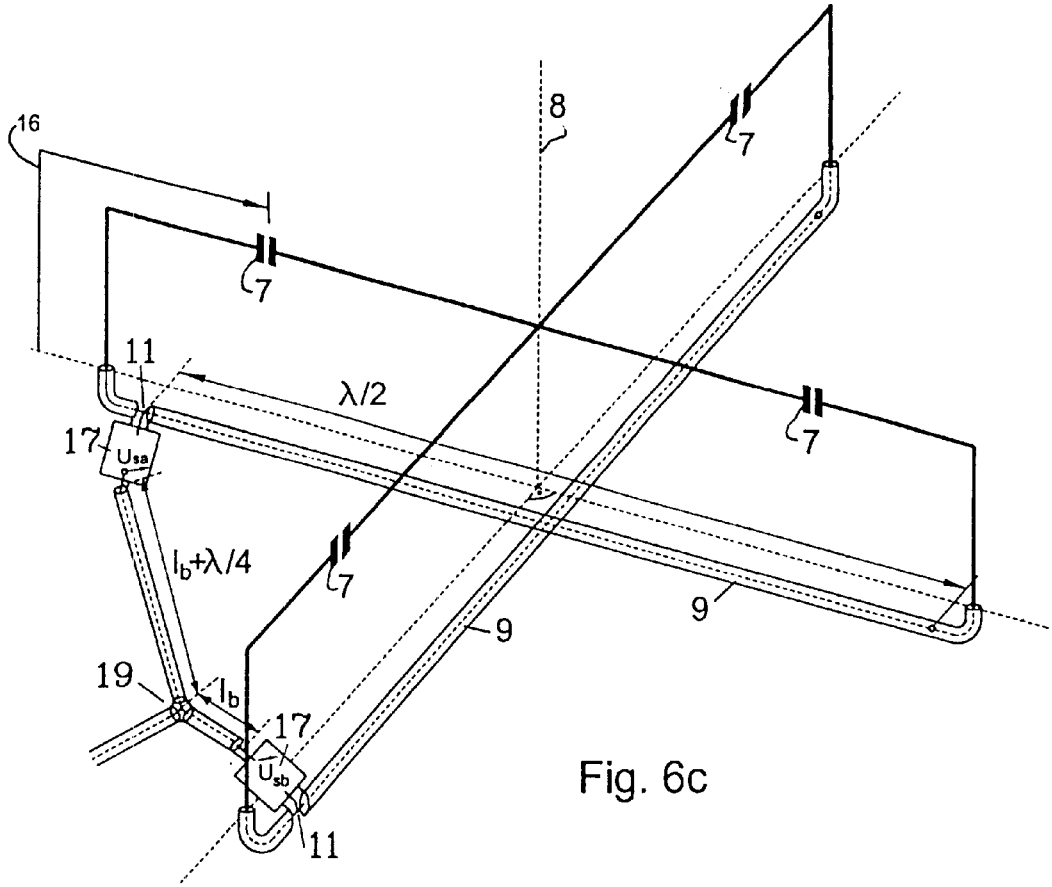
FIG. 6*c* shows a 3-dimensional diagram of the antenna for circular polarization.

FIGS. 6*a* and 6*c* show an advantageous embodiment of the invention using the combination of a plurality of antennas of FIG. 5 as a satellite communications antenna for circular polarization. Here, two antennas whose planes 0 are orthogonal to one another are combined in a particularly advantageous embodiment, wherein each antenna, has an asymmetrizing network 9 and a matching circuit 17. At the output of matching circuit 17, the voltage Uz for circular polarization is formed by means of a phase-rotation element 18, and a summation circuit 19. The latter, as shown in FIG. 6*c*, are constructed by connecting in parallel, lines whose lengths differ by λ/4. As shown in FIG. 6*b*, matching circuit 17 can be constructed using printed reactive elements. The lines for asymmetrization are constructed as lines 10*a, b,* the network for matching is constructed as series-connected or branch lines 17, and the network for interconnection and 90 degree phase rotation is constructed as line 18, by printed circuit technology.

Figure 12A:
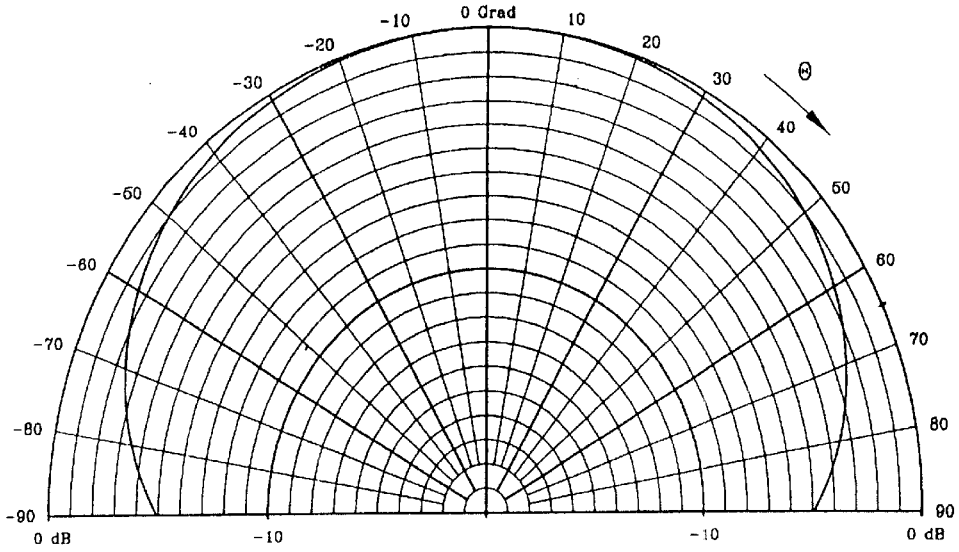
FIG. 12*a* shows an elevation diagram of an example of an inventive antenna.
Figure 12B:
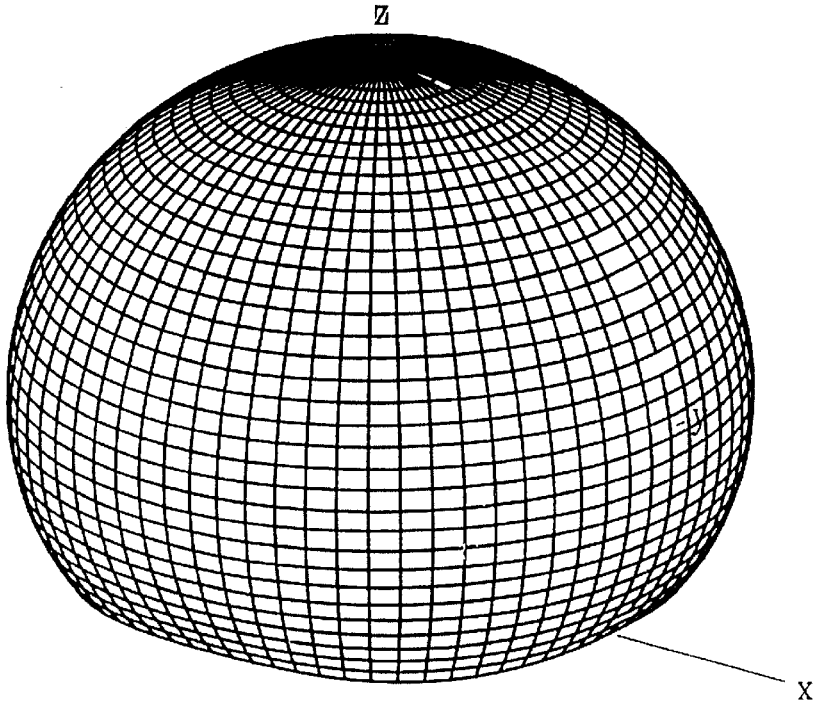
FIG. 12*b* shows an inventive antenna illustrated in three dimensions.

With antennas of this embodiment, a suitable elevation diagram according to FIG. 11, having the character of diagrams D2 and D3, is established for the individual antenna according to FIG. 5. After interconnecting the antennas as in FIG. 6*c*, there is established the overall diagram required for circular polarization as shown in FIG. 12*a*, (azimuth angle section=constant) and FIG. 12*b* (3-dimensional diagram).

Figure 13:
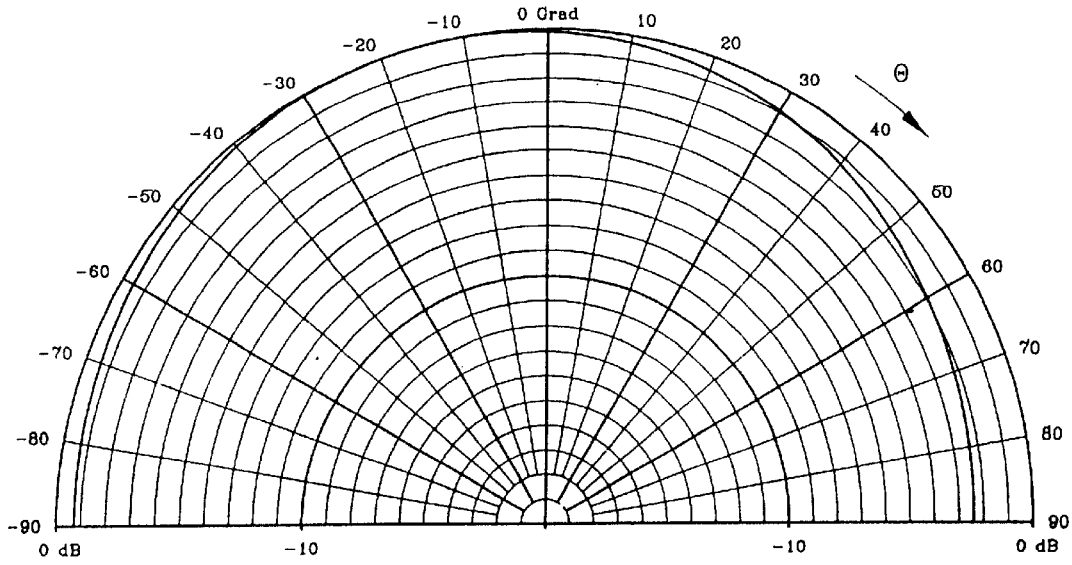
FIG. 13 shows an elevation diagram of an example of a squinting inventive antenna.

In the case of an inclined orientation of the conductive base surface, for example for a curved vehicle roof in the peripheral region of a window, the asymmetry of conductive base surface 1 and the inclination can be compensated for by selecting different capacitances in the individual antenna branches. This corresponds to a skewing of the diagram. As an example, FIG. 13 shows a squinting diagram that can be established with inventive antennas and that has a squint angle of about 15 degrees relative to the zenith angle.

Figure 7A:
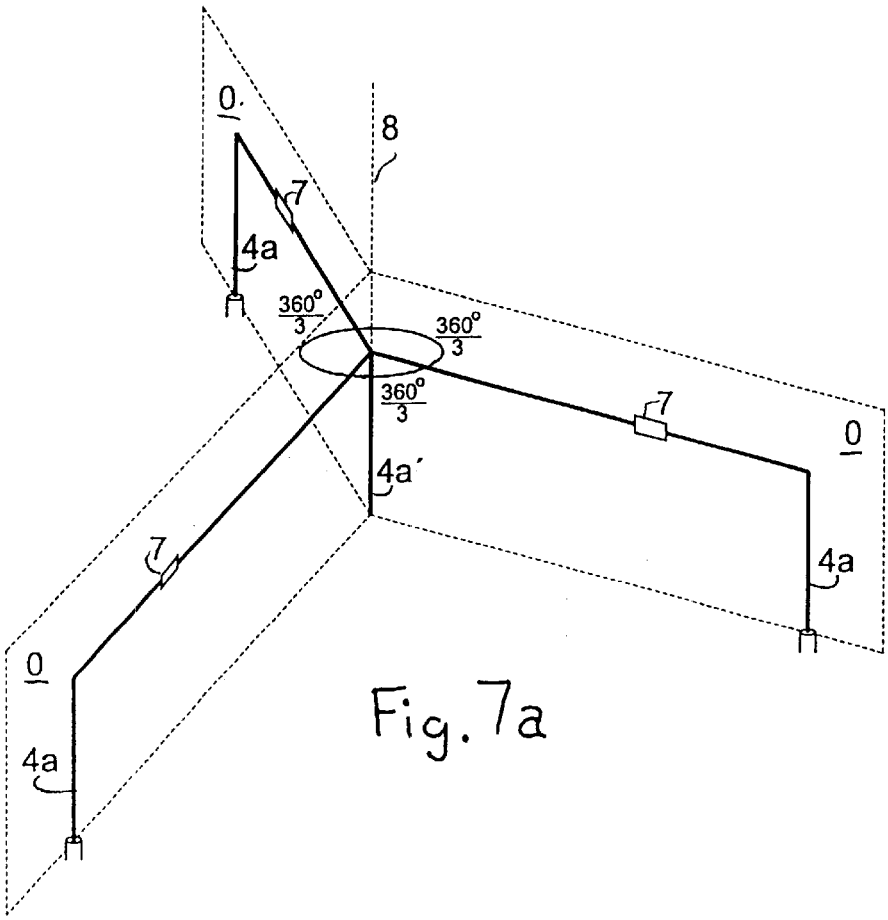
FIG. 7*a* shows an antenna for circular polarization, formed from three antennas according to the invention in three planes disposed azimuthally at 120° angles.
Figure 7B:
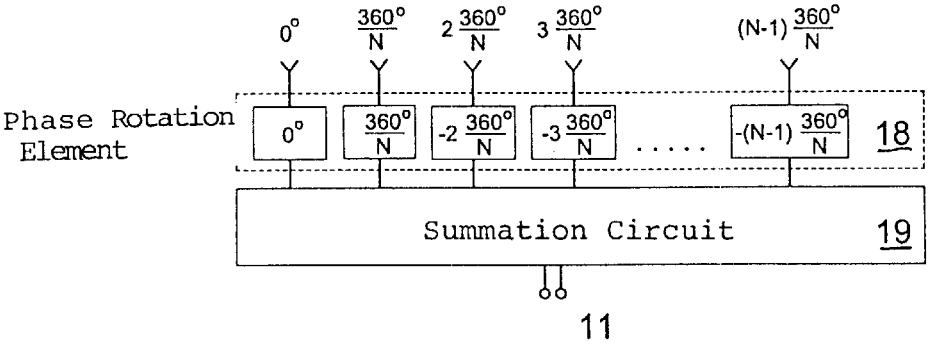
FIG. 7*b* shows the output signals of the antennas of FIG. 7*a* combined via a 120 degree phase-rotation element in a summation circuit.
Figure 8:
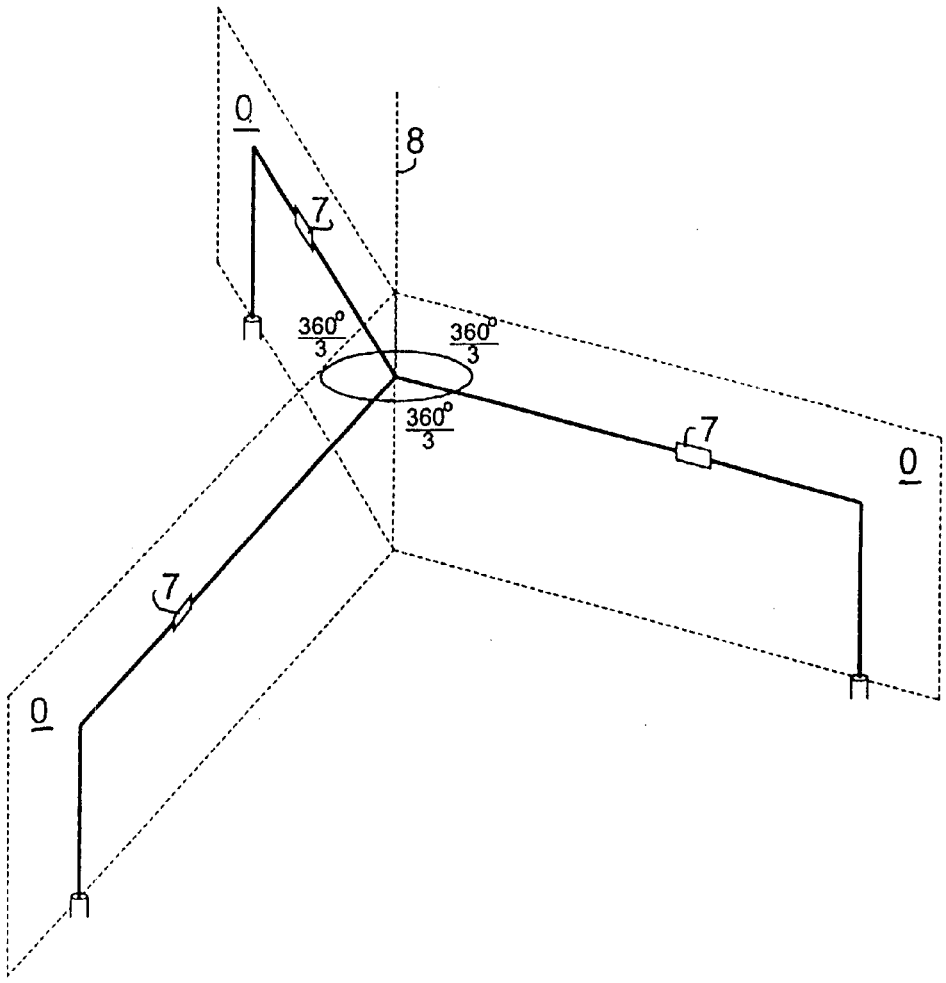
FIG. 8 shows an antenna for circular polarization according to FIG. 7, without vertical conductor 4*a*' at the symmetry point of the antenna arrangement.

FIG. 7*a* shows a further advantageous embodiment of the invention, where N antennas can be disposed in rotationally symmetrical manner at an angular spacing of respectively 360/N degrees around a vertical symmetry line 8. Correspondingly, FIG. 7*b* shows a circuit for the antenna of FIG. 7*a* providing phase-rotation elements 18 which have a respective phase-rotation angle of 360/N degrees, and whose output signals are combined in a summation circuit 19, and are available at collection point 11. The configuration of impedance 7 is determined by the rules mentioned above. The roundness of the azimuthal directional diagram can be further improved by a choice of sufficiently large values of N. The rotational symmetry of this arrangement makes it possible to dispense with vertical conductor 4*a*', as shown in FIG. 8.

In a further advantageous embodiment of the invention, the satellite communications antenna is expanded to a combination antenna for additional terrestrial communication with vertical polarization at a frequency different from the satellite radio frequency. This is accompanied very advantageously by a savings in overall space in motor vehicles.

Figure 9A:
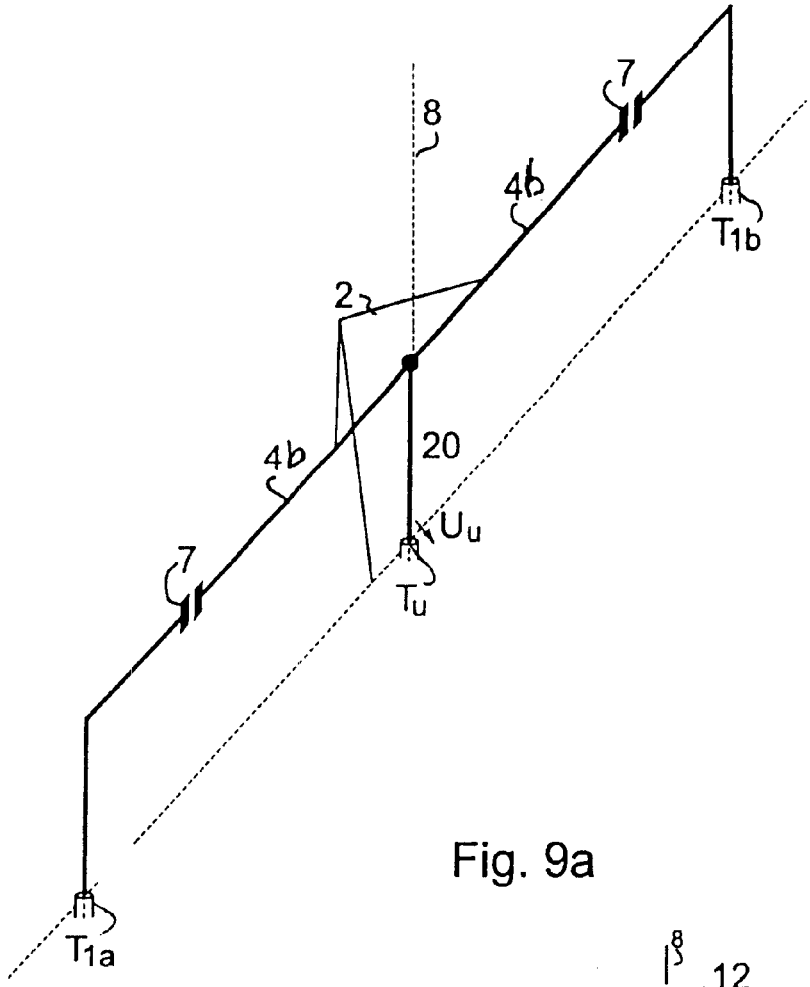
FIG. 9*a* shows an antenna according to the invention with a further connecting gate Tu for coupling out an asymmetric voltage.
Figure 9B:
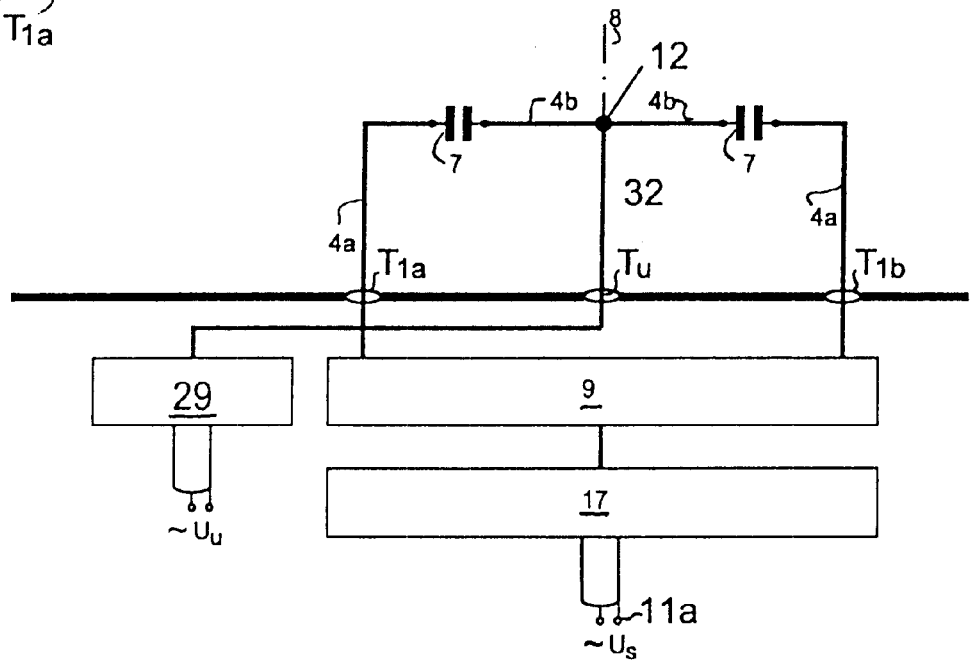
FIG. 9*b* is a circuit showing the principle of signal coupling out in an inventive antenna of FIG. 9*a*.

FIG. 9*a* shows a symmetric antenna configured from two antennas according to the basic form of this invention. Here, a vertical antenna conductor 20, which is connected at one end to a horizontal part of ring structure 2, is formed along symmetry line 8. A connecting gate Tu, for generating an asymmetric voltage Uu is formed between the lower end thereof and conductive base surface 1. In this case, the conductor parts having horizontal extension 4*b* act as the roof capacitor for vertical antenna conductor 20. The symmetrical voltages are tapped from ring structure 2 at the corresponding gates T1*a* and T1*b*. Matching network 29 in FIG. 9*b* is used for frequency-selective matching of the impedance present at connecting gate Tu for the frequency of the terrestrial radio service to the characteristic wave impedance of standard coaxial lines. The voltage ~Uu proportional to Uu, is present at the output of this matching network 29.

In order not to impair the satellite radio service, matching network 29 can be advantageously configured so that connecting gate Tu, for the satellite radio frequency, is loaded with a reactance or, advantageously, with a short or open circuit. The symmetry of the arrangement can be used advantageously for decoupling connecting gate Tu from connecting gates T1*a*, T1*b* by wiring them to an asymmetrizing network 9. This is particularly important for protection of the satellite radio service when terrestrial communication takes place bidirectionally. If any residual asymmetry remains, the satellite radio service can be decoupled by designing asymmetrizing network 9 so that connecting gates T1*a* and T1*b*, over the frequency of the terrestrial radio service, are loaded with a short circuit.

Figure 10A:
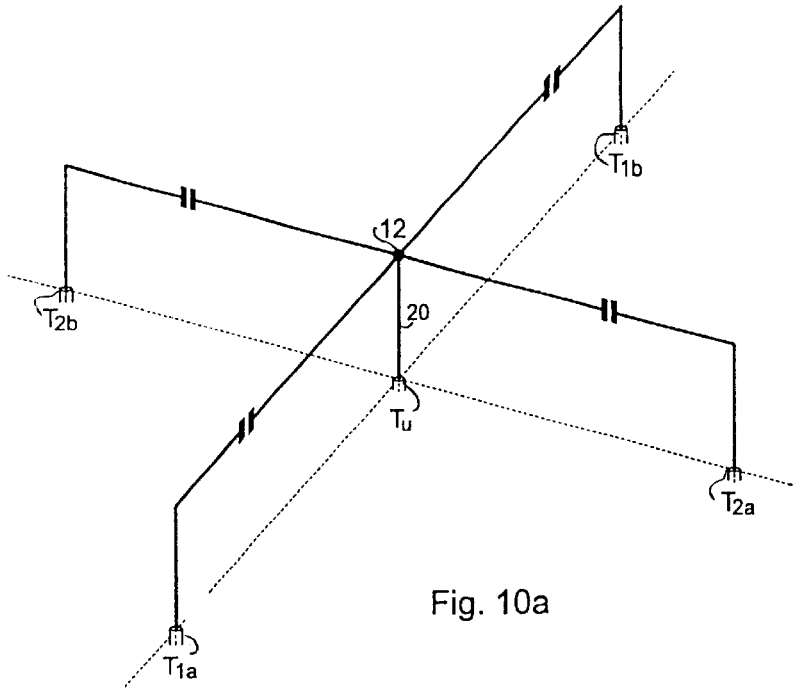
FIG. 10*a* shows an antenna for circular polarization, formed from two antennas according to the invention in orthogonal planes.
Figure 10B:
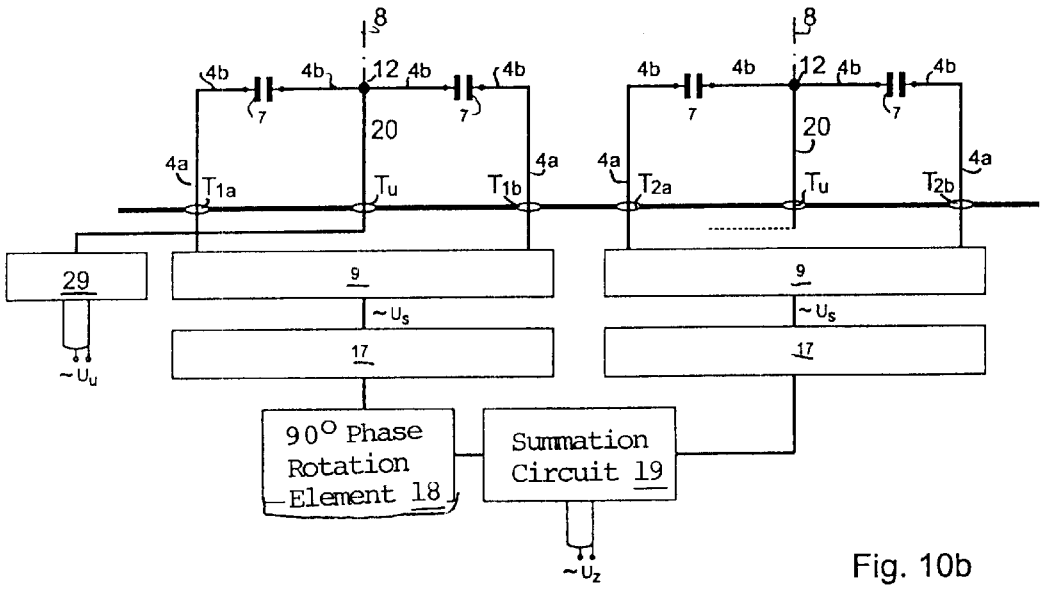
FIG. 10*b* shows a circuit for signal coupling out for the antenna of FIG. 10*a*.

FIG. 10*a* illustrates the complete satellite communications antenna for circular polarization together with vertical antenna conductor 20. In FIG. 10*b*, an asymmetrizing network 9 is shown coupled to a matching circuit 17 in a manner corresponding to the antenna in FIG. 6*c*. The output signals of the antennas are combined via a 90-degree phase-rotation element 18 in a summation circuit 19, with a further connecting gate Tu for coupling out an asymmetric voltage. Thus, connecting gates T2*a* and T2*b* of the antenna are phase rotated by 90 degrees relative to the other antenna with gates T1*a*, T1*b*. As regards protection of the satellite radio service, the explanations given above are also applicable to the loading of gates T2*a* and T2*b* for the frequency of the terrestrial communications service.

Figure 14A:
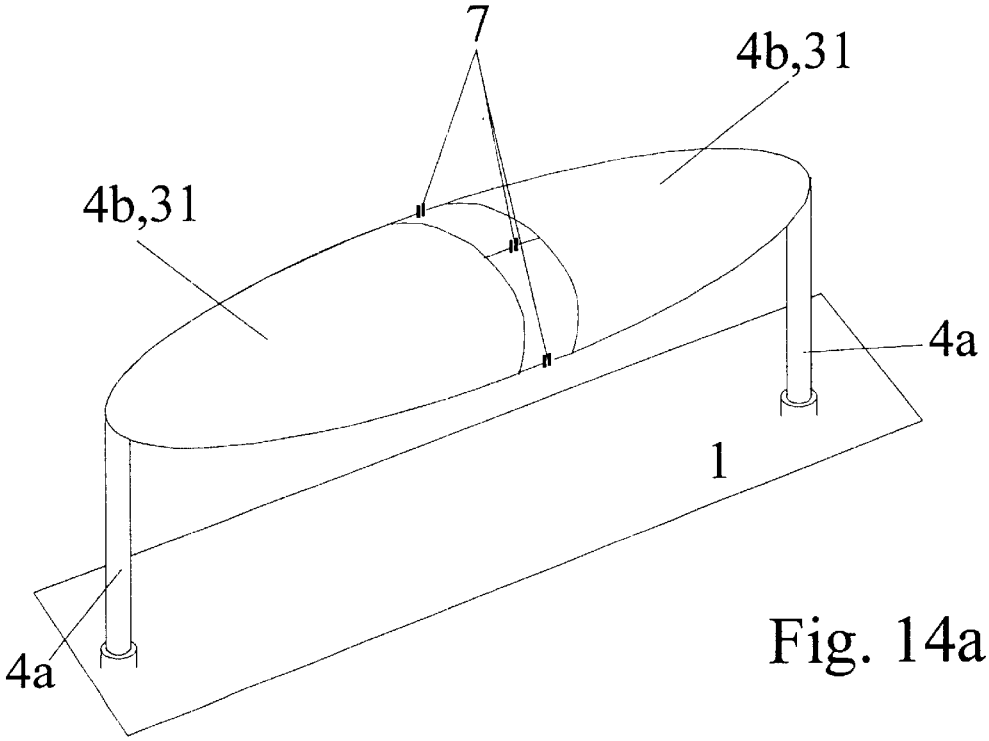
FIG. 14*a* shows a structure of a sheet-type roof capacitor in the form of a semiellipsoid parallel to a plane, interrupted by an impedance.
Figure 14B:
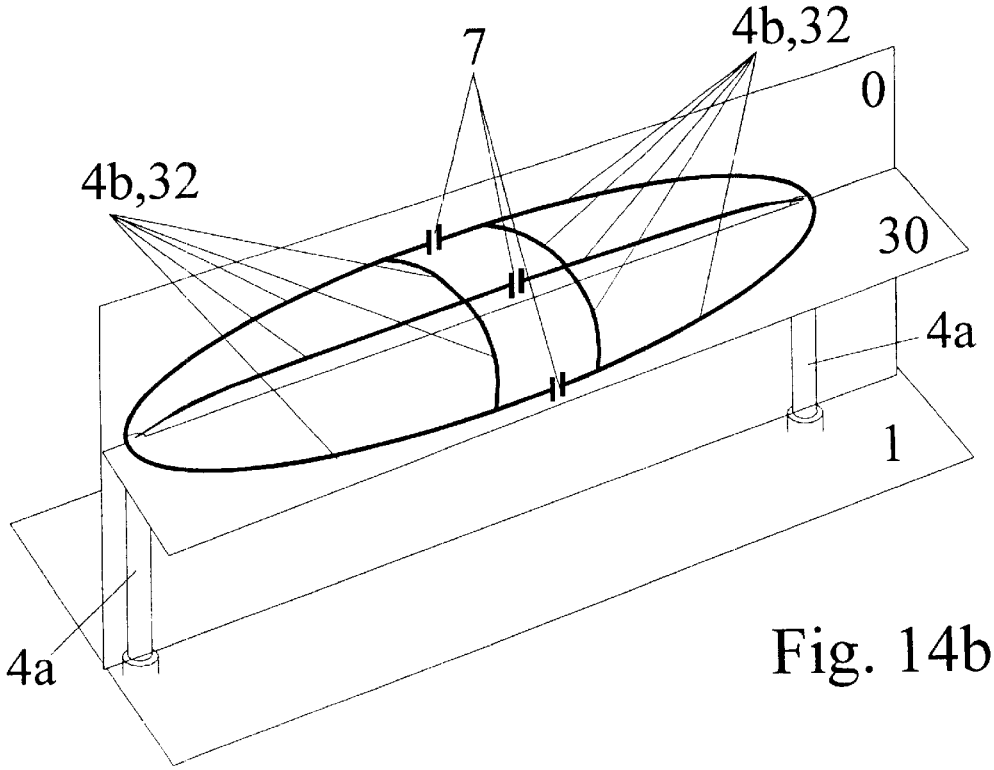
FIG. 14*b* is similar to FIG. 14*a*, but with a conductor-like structure of the semiellipsoid.

FIGS. 14*a* and 14*b* show an advantageous embodiment of the invention, with conductor parts having substantial horizontal extension 4*b* configured in the shape of a semiellipsoid for formation of a roof capacitor 31 with a curved surface. The periphery is merged into a surface 30 which, in one of its dimensions, is oriented substantially perpendicular to plane 0 and thus substantially parallel to plane 1. Thus, by suitable choice of the size and shape of the surface curved effectively as roof capacitor 31, in combination with the appropriate dimensioning of impedances 7, both the vertical diagram and the foot-point impedances present at the foot point of the conductor parts having substantial vertical extension 4*a* can be adjusted as desired. Thus, the conductor parts having substantial horizontal extension 4*b* which form roof capacitor 31 can be made from wirelike or striplike conductors, as is indicated in FIG. 14*b*, and also as grid structures.

Figure 15A:
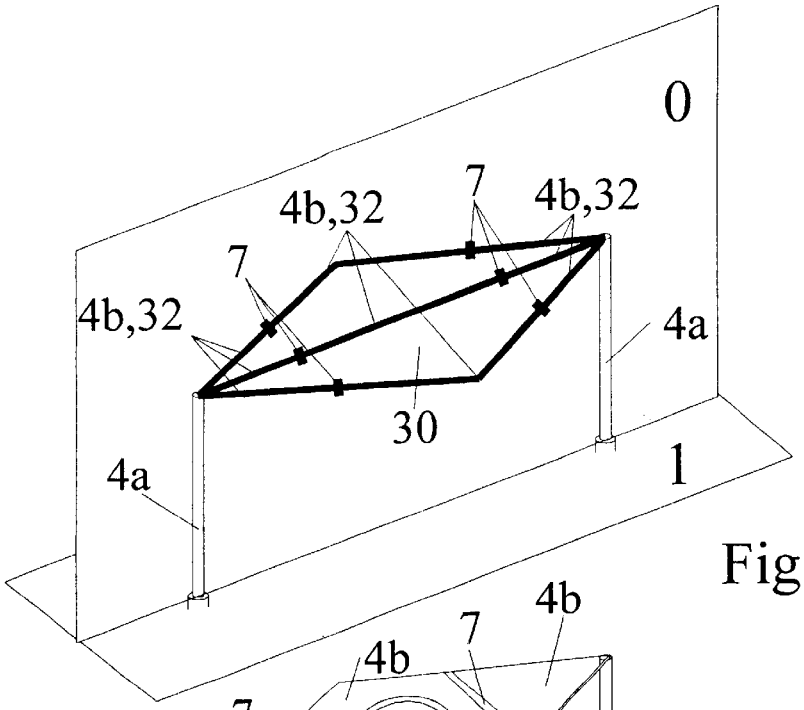
FIG. 15*a* shows wirelike or striplike conductor parts extending substantially horizontal in a plane.
Figure 15B:
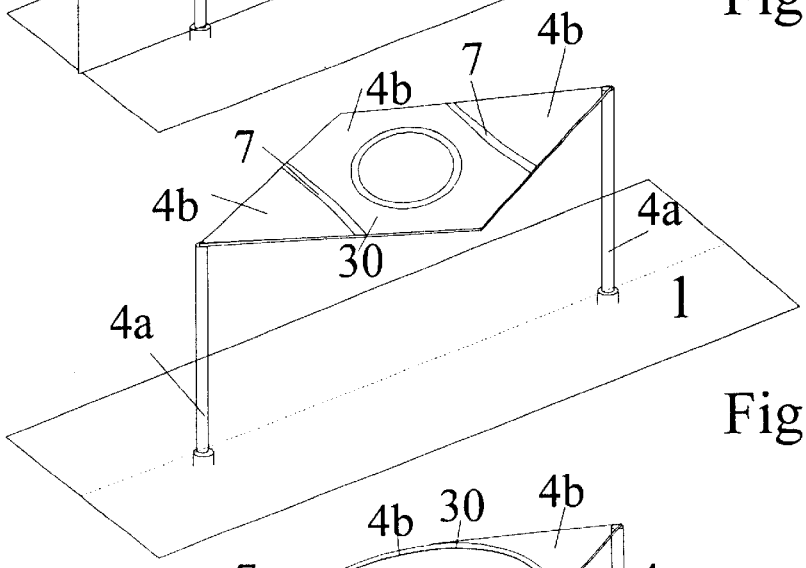
FIG. 15*b* is similar to FIG. 15*a*, but with sheet-type conductor parts, preferably of a printed circuit type.

FIGS. 15*a* and 15*b* show an embodiment of a roof capacitor 31, formed in a particularly simple manner, and disposed completely in a surface 30 as a plane parallel to conductive base surface 1. It is preferably designed as a printed circuit. Thus, both roof capacitor 31 and impedances 7, which are usually capacitive, can be manufactured with high accuracy and reproducibility. Therefore, both the directional diagram and the aforesaid foot-point impedances can be provided with small dispersions during series manufacture.

Figure 16:
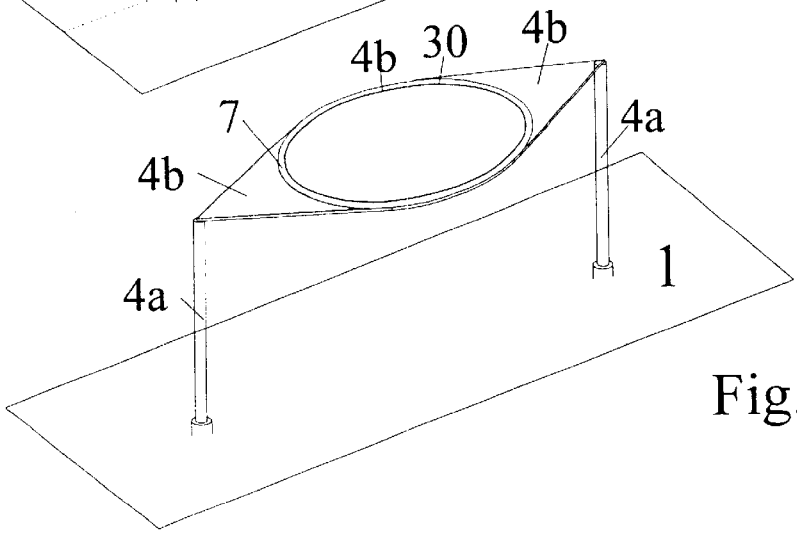
FIG. 16 shows an embodiment similar to that of 15*b*, also of a printed circuit type.

A further inventive embodiment with printed circuitry is shown in FIG. 16. Here, the conductor parts having substantial horizontal extension 4*b*, and a plurality of impedances 7, 7' are constructed so that in ring structure 2, with respect to plane 0 where the conductor parts having substantial vertical extension 4*a* are routed, an antenna arrangement is provided that is also symmetrical with respect to the impedance values of impedances 7, 7'. In this case, the antenna arrangement must also be symmetrical with respect to a symmetry plane 33 oriented perpendicular to both base surface 0 and base plane 1, as shown in FIGS. 17*a*, 17*b* and 17*c*.

Figure 17A:
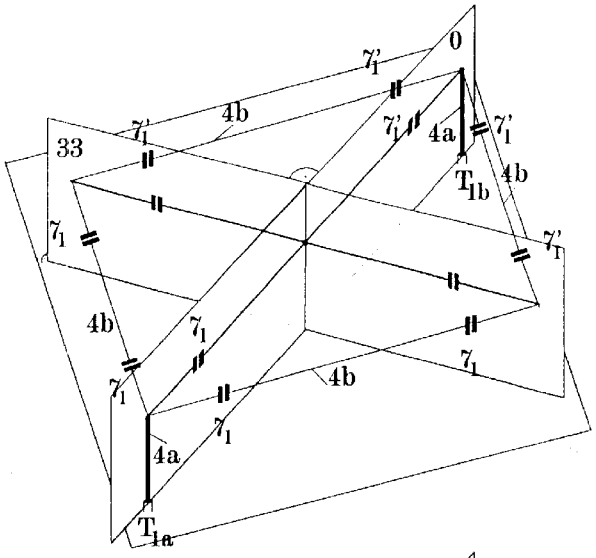
FIGS. 17*a, b* and *c* show the main principle of operation of inventive antennas with strictly symmetrical construction from the viewpoint of the capacitive coupling effects.
Figure 17B:
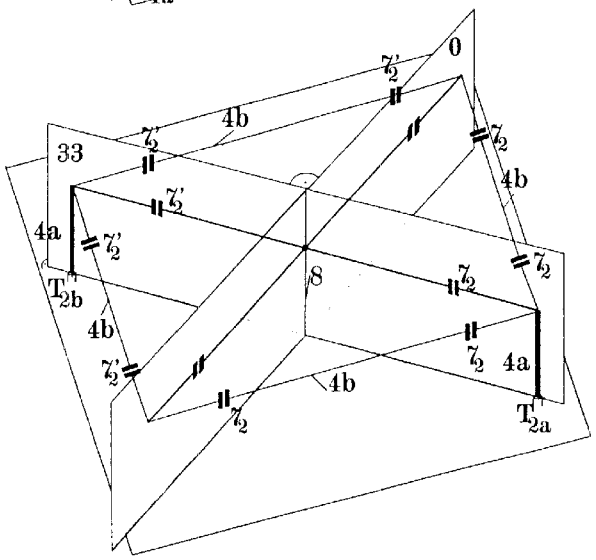
Figure 17C:
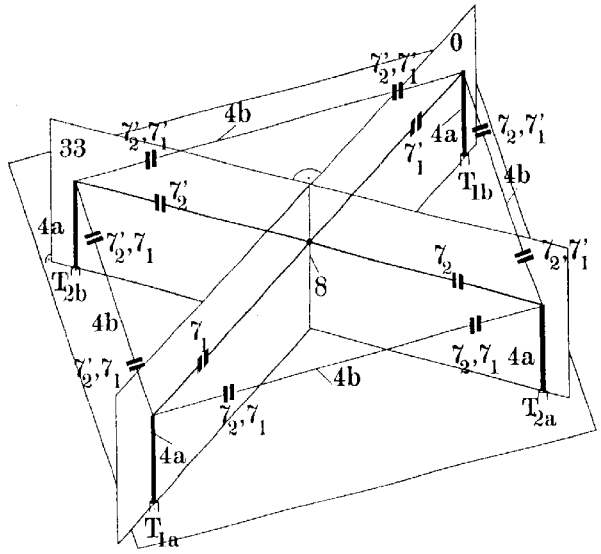

To explain the principle of operation of the antenna of FIG. 17*c*, it is first necessary to consider ring structure 2 in FIG. 17*a*. This ring structure contains capacitors 7, 7' and, if the capacitors disposed symmetrically with respect to the vertical symmetry line are identical, the frame formed thereby is also electrically symmetrical. The capacitors between conductor parts having substantial horizontal extension 4*b* also do not perturb this symmetry, nor does the surrounding space. Thus the arrangement in FIG. 17*a* provides an antenna which is configured according to the invention and in addition has the property of symmetry. For a clearer understanding of the principle of operation of this antenna arrangement, plane 0, in which conductor parts have a substantial vertical extension 4*a*, is shown along with symmetry plane 33.

Because of the coupling of an asymmetrizing network 9, as in FIG. 9*b*, a voltage Us can therefore be coupled out of the symmetrical antenna arrangement via connecting gates T1*a* and T1*b*. In operation, no conductor parts having substantial vertical extension 4*a* are mounted in plane 33 in FIG. 17*a*. Corresponding to the nomenclature in FIG. 3*a*, the impedance 7 is on the one side of vertical symmetry line 8, in FIGS. 17*a* to 17*c*, and impedance 7' is on the other side of symmetry line 8. In FIG. 17*a*, therefore, all impedances that are effective with respect to the gates denoted by T1*a* and T1*b* are indicated by 7 or 7' as is appropriate for their placement relative to symmetry plane 33 and, by virtue of the common action on gates T1*a* and T1*b*, are additionally identified with subscript 1. The unmarked capacitors, which in FIG. 17*a* are disposed in symmetry plane 33, have no effect with respect to gates T1*a* and T1*b*.

In FIG. 17*b*, the conductor parts having substantial vertical extension 4*a* relative to gates T1*a* and T1*b* have been omitted for clarity. Assuming a constant arrangement of all reactive elements 7 described in FIG. 17*a*, a ring structure 2, with associated gates T2*a* and T2*b* is formed in symmetry plane 33. The designations for reactive elements 7 are therefore related correspondingly to these two gates, in accordance with the nomenclature of FIG. 17*a*. By combining the two ring structures 2 in FIGS. 17*a* and 17*b* as the complete arrangement illustrated in FIG. 17*c*, there is provided two ring structures 2 that are completely symmetrical with respect to vertical symmetry line 8.

Figure 18A:
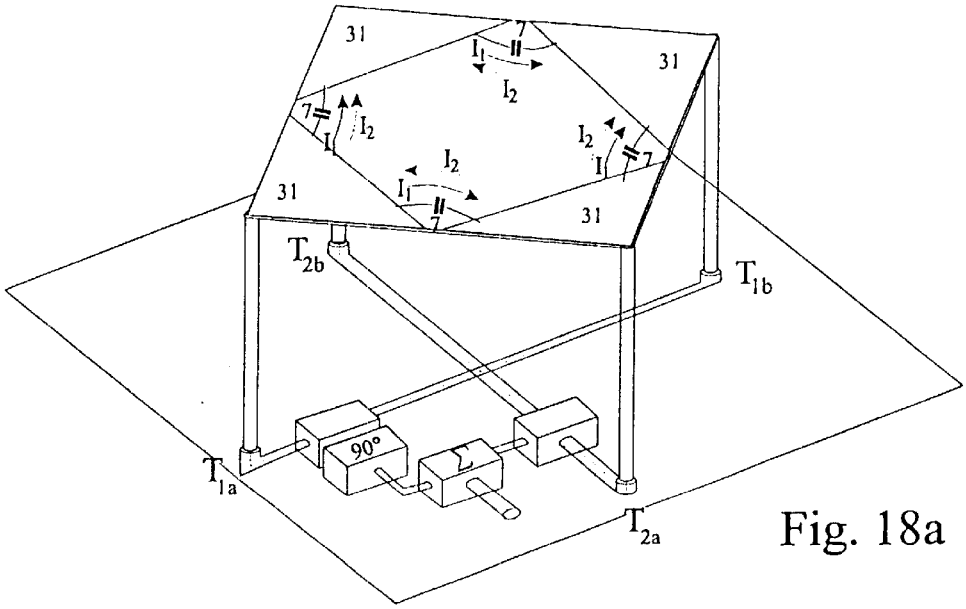
FIG. 18*a* shows an inventive antenna for circular polarization and strictly symmetrical construction with triangular roof capacitors.

FIG. 18*a* shows an antenna with a suitable choice of the dimensions of roof capacitors 31, representing coupling capacitors, similar to FIG. 17*c*, and also configured with suitable construction of the roof capacitors, so that the coupling capacitors form impedances 7 having the required size to be effective according to the invention.

In FIG. 18*a*, current arrows drawn for currents I1 and I2 to indicate the main current flow of the two frames 2. The current arrows indicate how the impedance network with impedances 7 act commonly for both frame parts. For impedances 7, currents I1 and I2 are superposed uniformly, and in an opposite sense. FIG. 18*a* shows how the four gates T1*a*, T1*b*, T2*a*, T2*b* are wired to provide an antenna for circularly polarized radiation.

Figure 18B:
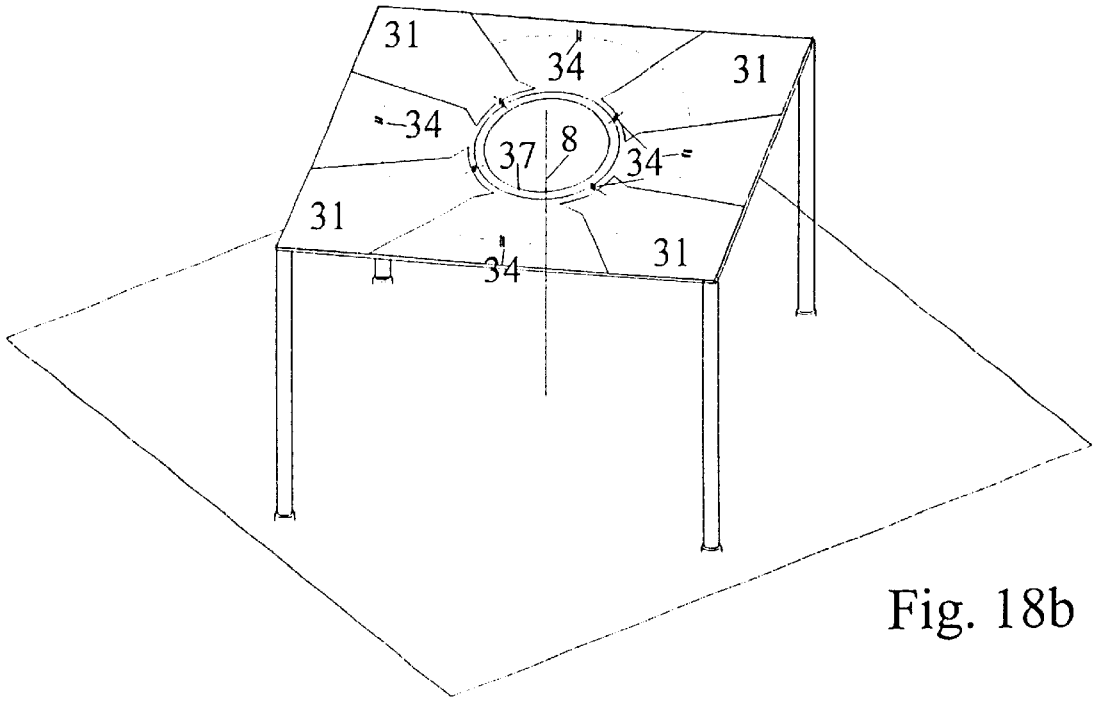
FIG. 18*b* shows an antenna with a ringlike central structure and coupling capacitors.
Figure 19:
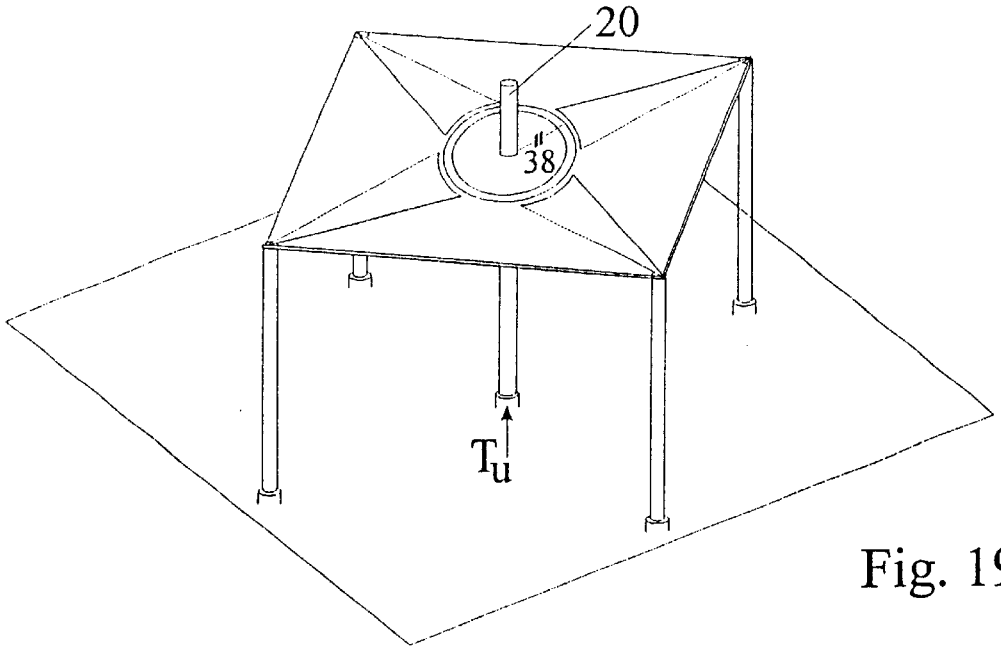
FIG. 19 shows an inventive antenna similar to that of FIG. 18*b*, but with an additional vertical antenna conductor in the vertical symmetry line.
Figure 20:
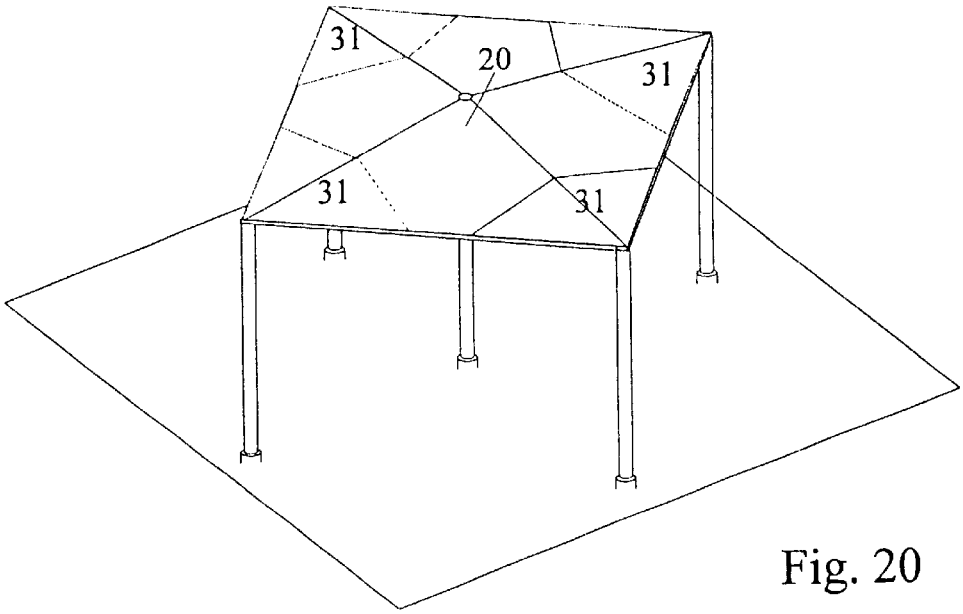
FIG. 20 shows a combination of roof capacitors, which are formed on a dielectric body having the shape of a truncated pyramid.

Practical examples of an antenna of this type are described in FIGS. 18*b*, 19 and 20. In FIG. 18*b*, the two frames are coupled in the vicinity of vertical symmetry line 8 via a conductive central structure 37, and preferably with printed coupling capacitors. The correspondingly configured roof capacitors 31 with their coupling capacitors 34 respectively, and these capacitors to central structure 37 of ring-like shape permit the antenna to be dimensioned with a desired directional diagram.

In FIG. 19, conductive central structure 37 of the antenna in FIG. 19 has a ring-like structure. A vertical antenna conductor 20 can then be used to provide the desired impedance at connecting gate Tu. Conductor 20 is coupled to ring-like structure 37 via a radiator coupling capacitor 38, in simple manner.

FIG. 20 shows a further example of an antenna having a combination of roof capacitors 31, which are provided on a dielectric body as truncated pyramids, so that a suitable directional diagram can be established via the coupling and space capacitors.

In a further embodiment of the invention, the antenna is designed for coordinated and simultaneous reception of circularly polarized satellite radio signals, and vertically polarized signals radiated by terrestrial radio sources in a high-frequency band of closely adjacent frequencies. Here, frequency-selective decoupling of the terrestrial radio service from the satellite radio service is not possible, because of the small frequency separation. In contrast, the symmetrical embodiment of the antennas described herein has a complete decoupling between vertical antenna conductor 20 and the output for reception of circular polarization Uz. Thus the system does not rely on narrow-band frequency selection between the two radio services. Thus, the signals radiated from both terrestrial and satellite stations can be received independently of one another. Thereby mutual damping due to power consumption at the respective other gate does not occur. By virtue of the symmetry of the antenna, this antenna property also exists for signals of identical frequency in that the reception of vertically polarized electrical field components at vertical antenna conductor 20 does not cause any damping with respect to the reception of vertically polarized electrical field components at the output gate for reception of the circular polarization signal Uz. This is the situation for the antennas according to FIGS. 10*a*, 10*b*, 19, 20 and 22.

Figure 21A:
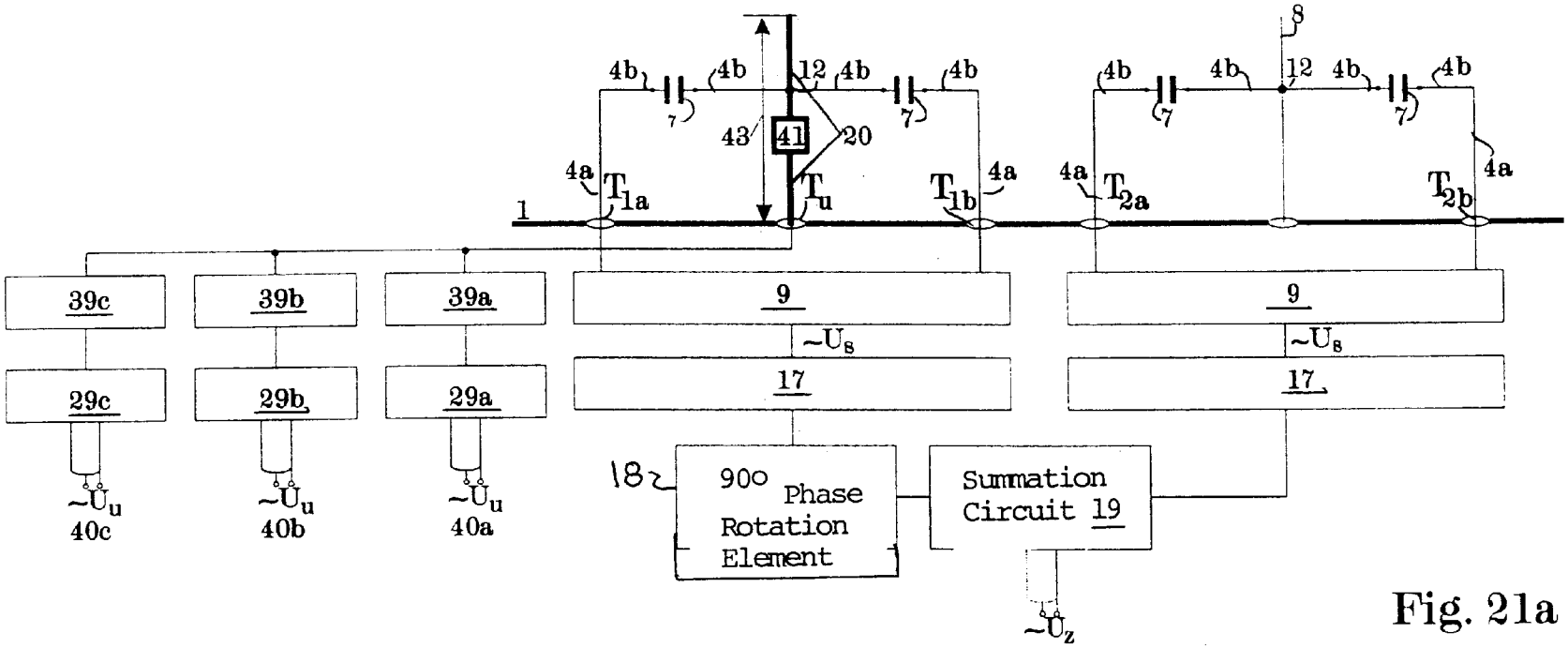
FIG. 21*a* is similar to FIG. 10*b*, but with further connecting gates for coupling out asymmetric voltages for additional radio services.
Figure 21B:
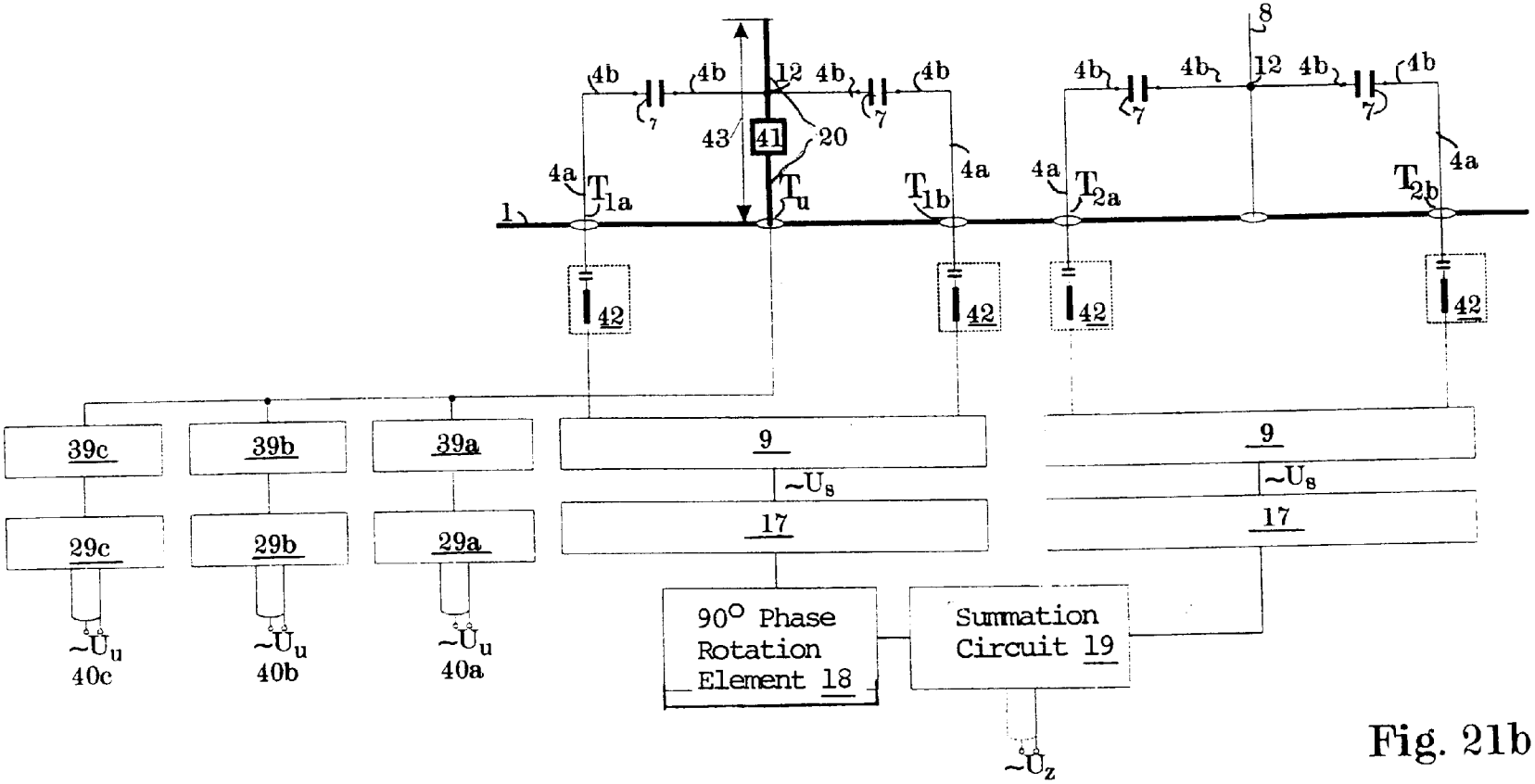
FIG. 21*b* is the same as FIG. 21*a*, but with frequency-selective decoupling networks in the connecting gates.
Figure 22:
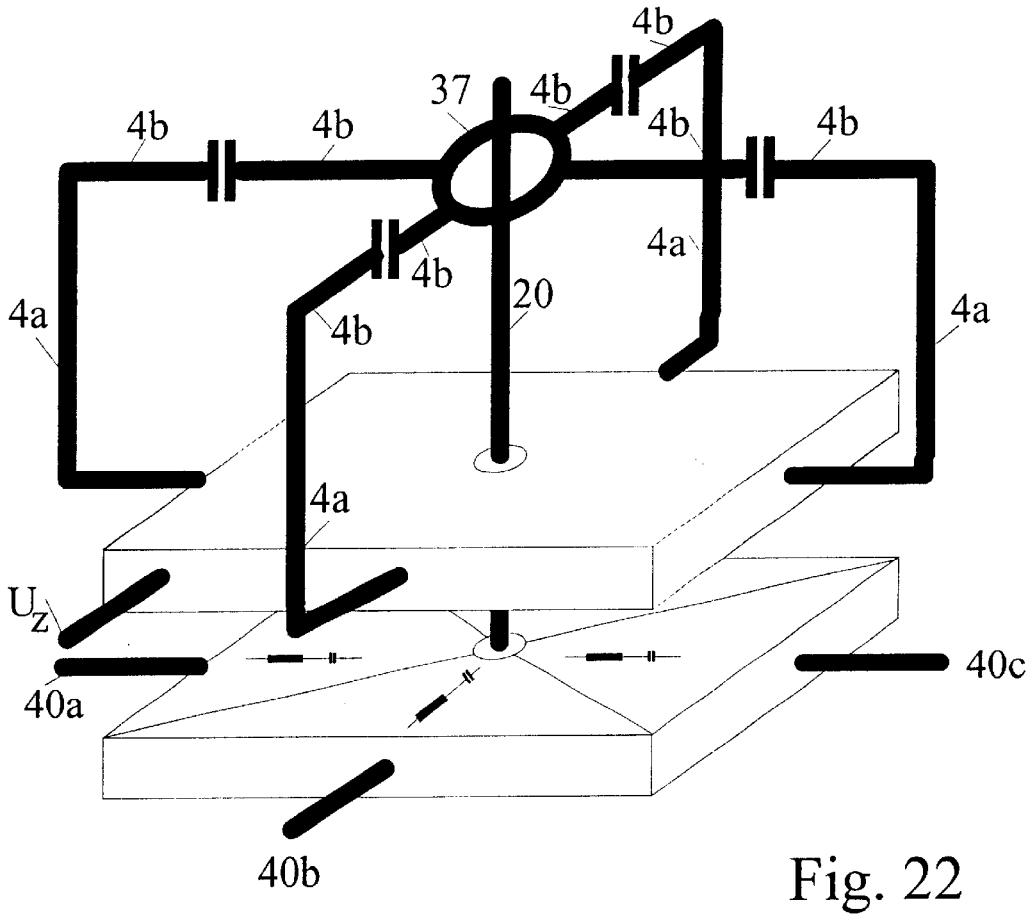
FIG. 22 shows a construction of an inventive antenna for both satellite, and a plurality of terrestrial radio services.

FIG. 22 shows a further embodiment of the invention with an antenna for a combined bidirectional radio operation with vertically polarized terrestrial radio sources. Here, vertical antenna conductor 20 is additionally used for at least one bidirectional radio operation with vertically polarized terrestrial radio sources. For this purpose a sufficiently large value is advantageously chosen for radiator length 43 of vertical antenna conductor 20 for the radio service with the lowest frequency. In the length 43 of conductor 20 has to be shortened as may be necessary for higher radio channel frequencies, interruption points with suitable reactive elements 41, can be inserted in conductor 20 as indicated in FIGS. 21*a* and 21*b*, for a proper configuration of the vertical diagram, and for obtaining the desired foot-point impedance for this frequency.

FIG. 21*a* shows a block diagram of such a combination antenna. In order to achieve the impedance matching for the various radio services, corresponding matching networks 29*a*, 29*b*, 29*c* with outputs 40*a*, 40*b*, 40*c*, respectively, are advantageously used for connection of the corresponding radio devices. To separate the impedance effects and the signals in the various frequency ranges, the inputs of matching networks 29*a*, 29*b*, 29*c* are connected via frequency-selective isolating circuits 39*a*, 39*b*, 39*c* respectively to the common connecting gate Tu, so that the matching conditions at connecting gate Tu are mutually influenced as little as possible in the radio-frequency channels of the various radio services.

FIG. 21*b* shows a further improvement over the circuit of FIG. 21*a*. To avoid the radiation-induced coupling between connecting gate Tu of vertical antenna conductor 20 and connecting gates T1*a*, T1*b*, T2*a*, T2*b* respectively of ring structures 2, decoupling networks 42 are provided and connected to the foot points of the conductor parts having substantial vertical extension 4*a*. Networks 42 are designed to block signals at the frequency of a bidirectional radio operation with vertically polarized radio sources, but allow the frequency of the circularly polarized satellite radio signal to pass. Thus, the impedances that exist at gates T1*a* and T1*b* via asymmetrizing network 9 do not cause radiation damping at the frequency of a bidirectional radio service because of their active components, or have a perturbing influence on such a frequency because of undesired reactances.

Accordingly, while several embodiments of the present invention have been shown and described, it is to be understood that many changes and modifications may be made thereunto without departing from the spirit and scope of the invention, as defined in the appended claims.

What is claimed is:

1. An antenna for mobile satellite communication disposed on a substantially horizontally oriented conductive base surface (1) with substantially linear conductor parts (4) having at least one antenna connection point (5) comprising:

a high frequency conducting ring structure (2) formed from the conductor parts (4) having a substantial vertical extension (4*a*) and a substantial horizontal extension (4*b*) together with the conductive base surface (1), wherein the conductor parts having substantial vertical extension (4*a*) and horizontal extension (4*b*) are connected in series and are disposed substantially in a plane (0) standing perpendicular to the conductive base surface (1), and wherein one of the conductor parts having either a substantial vertical extension (4*a*) or a horizontal extension (4*b*) is interrupted to form a first antenna connection point (5); and, at least one impedance (7) coupled to an impedance connection point (6) disposed on a further interruption of said conductor parts (4*a*), (4*b*), wherein the positions of said impedance connection point (6), the antenna connection point (5), and said impedance (7) are selected so that, for the plane (0) standing perpendicular to the conductive base surface (1), with waves polarized in this plane, the predetermined antenna gain values are optimized for a predetermined elevation angle (81) of the incident satellite wave (80).

2. The antenna according to claim 1, wherein the antenna connection point (5) is formed adjacent to the base surface (1) on one end of the conductor part having said substantial vertical extension (4*a*), the antenna connection point (5) having a first antenna terminal (5*a*) at the lower end of this conductor extension (4*a*) and a second antenna terminal (5*b*) at a point adjacent thereto on the conductive base surface (1), and wherein the position of said impedance connection point (6) and said impedance (7) are selected so that the desired asymmetry of the radiation characteristic with respect to the zenith is defined, while at the same time providing sufficient gain values at low elevation angles of the incident wave.

3. The antenna according to claim 2, wherein said conducting ring structure (2) has rectangular shape with a cross dimension (15) not substantially smaller than one half the operating wavelength so as to provide sufficient antenna gain values at low elevation angles (81) of the incident wave (80), in combination with a low overall height (14).

4. The antenna according to claim 2, wherein said impedance (7) is constructed as a capacitor, whose capacitance is adjusted according to the requirement of the antenna gain values to be achieved at the predesignated elevation angles of the incident wave (80).

5. The antenna according to claim 1, wherein said conducting ring structure (2) comprising:

two symmetrically disposed conductor parts (4) bisected by a symmetry line (8) disposed vertically on the conductive base surface (1);

a second antenna connection point (5') disposed symmetrically relative to the first antenna connection point (5) at the lower end of the other conductor part (4) intersecting the conductive base surface (1); and, a further impedance connection point (6') with an identical further impedance (7') disposed symmetrically relative to said first impedance (7), and wherein the wiring of the antenna connection point (5') is designed so that symmetrical voltages (Us) are established at both antenna outputs.

6. The antenna according to claim 5, comprising:

an asymmetrizing network (9) having its inputs coupled to said antenna connection points (5, 5'), so as to produce at its collection point (11) combined symmetrical voltages (Us) formed symmetrically relative to the base surface (1).

7. The antenna according to claim 6, wherein said asymmetrizing network (9) comprises two asymmetrical lines (10*a, b*) having identical characteristic wave impedances, each line being connected on the input side to an antenna connection point (5, 5'), and are connected in parallel at the output, wherein the electrical lengths of the lines differ from one another by an odd multiple of one half the operating wavelength.

8. The antenna according to claim 6, wherein the straight path (16) of the portion of the conductor part with the vertical extension (4*b*) disposed between the antenna connection point (5) and the position of said impedance (7) is approximately one quarter wavelength in order to optimize the impedance match with said asymmetrizing network (9).

9. The antenna according to claim 6, additionally comprising:

a low-loss matching circuit (17) having its input connected to said collection output point (11) in order to transform the complex impedance present at said collection output point (11) to a real impedance that can be constructed as a line-type characteristic wave impedance.

10. The antenna according to claim 6, wherein said asymmetrizing network (9) comprises:

a coupling-out network (9*a*) for coupling out asymmetrical voltages (~Uu) in combination with said asymmetrizing network (9), having its input connected to the antenna connection points (5), and the output of said coupling-out network (9*a*) provides in combined asymmetrical form, at a first collection point (11*b*), asymmetric voltages (~Uu) formed asymmetrically relative to the base surface (1), and wherein said asymmetrizing network (9) produces at its output the symmetrical voltages (~Us) formed symmetrically relative to the base surface (1), at a second collection point (11*a*).

11. The antenna according to claim 1, wherein the conductor parts having a substantial horizontal extension (4*b*) for formation of a roof capacitor (31) have a sheet-type configuration, and are disposed in a surface (30) which in one of its dimensions is oriented substantially perpendicular to the plane (0).

12. The antenna according to claim 11, wherein the conductor parts having a substantial horizontal extension (4*b*) for formation of the roof capacitor (31) are formed from wirelike or stripline conductors (32).

13. The antenna according to 11, wherein said surface (30) is formed as a plane parallel to the conductive base surface (1) as printed circuitry.

14. The antenna according to claim 13, wherein the conductor parts (4) having substantial horizontal extension (4*b*) and a plurality of impedances (7, 7') are formed as said ring structure (2) so that, relative to the plane (0) in which the conductor parts having substantial vertical extension (4*a*) are disposed, an antenna arrangement is provided that is also symmetrical with respect to the impedance values of the impedances (7, 7'), and a symmetry of the antenna arrangement is also provided with respect to a symmetry plane (33) oriented perpendicular both to the plane of the base surface (0) and to the base plane (1).

15. The antenna according to claim 14, comprising two identical antennas formed so that the plane (0) of the one antenna forms the symmetry plane (33) of the other antenna and vice versa, and the overall antenna arrangement is configured from congruent quadrants with respect to the vertical symmetry line (8) formed from the line of intersection of the plane (0) with the symmetry plane (33) of the antennas.

16. The antenna according to claim 15, wherein said antennas comprise sheet-type conductor structures (35) which respectively are galvanically isolated from one another, and whose peripheries adjacent to one another are suitably configured by shaping and by isolating gaps (36) disposed therebetween, so as to form the roof capacitors (31) of suitable size respectively loading the conductor parts having substantial vertical extension (4*a*) at their upper end, and wherein said impedances (7) are formed as coupling capacitors (34) for formation of the ring structures (2) of both antennas in the surface (30).

17. The antenna according to claim 16, wherein the region in the immediate vicinity of the vertical symmetry line (8) of conductor parts is left unoccupied, and the vertical antenna conductor (20) is coupled capacitively to parts of the ring structure (2), such as the central structure (37) or the roof capacitors (31), and the radiator length (43) and the radiator coupling capacitor (38) are selected so as to adjust the capacitive coupling to a value that provides a suitable impedance at the antenna connecting gate (Tu).

18. The antenna according to claim 15, comprising sheet-type conductor structures (35) disposed on a surface (30) which respectively are galvanically isolated from one another;

a central structure (37) surrounding the vertical symmetry line (8); and roof capacitors (31) capacitively coupled to form said impedances (7) as coupling capacitors (34) for formation of the ring structures (2) of both antennas, said roof capacitors (31) being of suitable size for respectively loading the conductor parts having a substantial vertical extension (4*a*) at their upper end.

19. An antenna for providing circular polarization, comprising:

two identical antennas with antenna connection points (5) and having substantially linear conductor parts (4*a*, 4*b*) disposed in orthogonal planes (0), and having impedances (7) connected in series therewith;

asymmetrizing networks (9) having their inputs connected to said antenna connection points (5);

matching circuits (17) connected to the outputs of said asymmetrizing networks (9);

a 90 degree phase-rotation element (18) having its input coupled to at least one of said antenna matching circuits (17); and, a summation circuit (19) connected to the output of said antenna matching circuits (17).

20. The antenna according to claim 19, comprising:

a conductive base surface (1) designed as a printed circuit board (27), for supporting said two identical antennas;

a micro stripline with a length of one half wavelength serving as said asymmetrizing network (9) and coupled to said antenna connection points (5) of both antennas; and wherein said matching circuit (17) is coupled to the output of said network (9) and constructed of reactive elements on said printed circuit board (27), and wherein said 90 degree phase-rotation element (18) is constructed as a printed phasing line (28) with matching characteristic wave impedance, and wherein said summation circuit (19) having one input connected to phase element (18) and another input connected to said matching circuit (17) is constructed as a simple parallel circuit of printed lines.

21. The antenna according to claim 9 further comprising a vertical antenna conductor (20) having one end coupled to the intersection and symmetry point (8) of said two antennas, and an antenna gate (Tu) connected at its opposite end.

22. The antenna according to claim 21, wherein when the length of the portion (16) of the antenna parts (4) between the antenna points (5) and the impedances (7) is designed to be about one quarter of the operating wavelength, and the capacitance of impedance (7) is selected so that the reactance is about 5 to 30 times greater than the impedance of a quarter-wave monopole antenna, so as to produce a sufficiently large antenna gain for radiation incident at small elevation angles, and so that the radiation incident from the zenith is sufficiently large to provide optimum reception.

23. The antenna according to claim 21, for providing coordinated and simultaneous reception of circularly polarized satellite radio signals and of vertically polarized radio signals radiated by terrestrial radio sources in a high-frequency band of closely adjacent frequency, having said vertical antenna conductor (20) with a further matching network (29) designed to receive the vertically polarized terrestrial radio signals with an asymmetric voltage (Uu), and the antenna with said matching circuit (17), said phase-rotation element (18) and said summation circuit (19) is designed to receive the circularly polarized satellite radio signals in the voltage for circular polarization (Uz), without active frequency-selective measures for mutual discrimination of the satellite radio signals from the terrestrial radio signals due to the decoupling resulting from the symmetry of the wave signals.

24. The antenna according to claim 23, wherein said vertical antenna conductor (20) connected to the intersection of said two antennas, has a sufficiently large radiator length (43) for the radio service with the lowest frequency for providing combined bidirectional radio operation with vertically polarized terrestrial radio sources, comprising:

corresponding matching networks (29*a*, 29*b*, 29*c*, . . . ) with outputs (40*a*, 40*b*, 40*c*, . . . ) for connection of the corresponding radio devices for the radio services, and the inputs of said corresponding matching networks (29*a*, 29*b*, 29*c*, . . . ) are respectively connected to said connecting gate (Tu) of said antenna conductor (20); and, frequency-selective isolating circuits (39*a*, 39*b*, 39*c*, . . . ) connected to said connecting gate (Tu) so that the matching conditions at said connecting gate Tu are mutually influenced as little as possible in the radio-frequency channels of the various radio services.

25. The antenna according to claim 24, comprising interruption points having suitable circuits of reactive elements (41) disposed along said vertical antenna conductor (20) for frequency-selective shortening of the electrically effective radiator length (43) for use with higher radio channel frequencies.

26. An antenna according to claim 24, comprising decoupling networks (42) disposed between the antenna connecting gates (T1*a*, T1*b*, T2*a*, T2*b*) and the asymmetrizing networks (9) for respectively blocking signals at the frequency of a bidirectional radio operation with vertically polarized radio sources, and designed to pass the frequency of the circularly polarized satellite radio signal so as to avoid the radiation-induced coupling between the connecting gate (Tu) of said vertical antenna conductor (20) and the connecting gates T1*a*, T1*b*, T2*a*, T2*b* of the ring structures (2).

27. An antenna for mobile satellite communication and having circular polarization comprising:

N identical antennas disposed in orthogonal planes (0) having substantially linear conductor parts (4), with vertical conductor parts (4*a*) at their ends, and respectively disposed in said planes (0), and wherein said planes (0) are respectively spaced apart from one another by an azimuthal angle of 360°/N, and intersect in a rotationally symmetric arrangement around a common vertical symmetry line (8)

a plurality of N impedances (7) each disposed in series in each of said N antennas;

a plurality of phase-rotation elements (18), whose electrical phase angle corresponds identically to the associated azimuthal angular spacing of the associated planes (0), and connected respectively to said end conductor parts (4*a*) for collecting the output signals of said N antennas; and, a summation circuit (19) connected to the output of said phase rotation elements (18) for combining the collected antenna signals.

28. The antenna according to claim 27, additionally comprising:

a central vertical conductor part (4*a*') disposed within said symmetry line (8) and common to all N antennas.

29. An antenna structure for mobile satellite communication disposed on a substantially horizontally oriented conductive base surface (1) with substantially linear conductor parts (4) having at least one antenna connection point (5) comprising:

a ring structure (2) formed symmetrically with respect to a central symmetry line (8) standing vertically on the conductive base surface (1), wherein the antenna connection point (5) is formed at a asymmetry point (12) disposed on a symmetry line (8) and dividing said ring structure into two identical conductor parts and, further comprising a first impedance connection point (6*a*), a second impedance connection point (6*b*) for receiving identical impedances (7) disposed symmetrically and in series in each conductor part, and connection wiring coupled to the antenna connection point (5) of each conductor part so that voltages (~Us)

are established symmetrically with respect to the symmetry point (12) for each of said two conductor parts with respect to the base surface (1).

30. The antenna structure according to claim 29, wherein said connection wiring comprises:

two straight conductors disposed parallel to one another along the symmetry line (8) forming a two-wire line (24) and coupled to the antenna connection point (5), at one end, and defining a line connection point (25) at the other end of said two-wire line (24) adjacent to the conductive base surface (1) so that a asymmetrical voltage (~Uu) is present between each conductor end and the conductive base surface (1), and a symmetrical voltage (~Us) is present between said two conductor ends.

31. The antenna structure according to claim 30, wherein said two-wire line (24) is designed as a shielded two-wire line (23), whose shield is connected at the other end of the line to the base surface (1).

32. The antenna structure according to claim 29, wherein said connection wiring comprises:

two coaxial lines disposed parallel to one another, wherein each inner conductor is connected at each end of the line to a terminal of the antenna connection point (5) of each conductor part, and the outer conductor is connected to the base surface (1), so that symmetric voltages (~Us) are established between said inner conductors, and asymmetrical voltages (~Uu) are established between each inner conductor and the base surface (1).

33. The structure according to claim 29 comprising:

a vertical antenna conductor (20) connected at one end to the center of said ring structure (2) to said two identical conductor parts, and disposed along its symmetry line (8); and, a connecting gate (Tu) disposed at the other end of the vertical antenna conductor (20) adjacent to the conductive base surface (1) for collecting an asymmetrical voltage (~Uu).

34. The antenna structure according to claim 33, additionally comprising:

a matching network (29) having its input connected to said connecting gate (Tu) for coupling out said asymmetric voltage (~Uu);

an asymmetrizing network (9), having its inputs connected to the antenna connection points (5) constructed as a first connecting gate (T1*a*) and second connecting gate (T1*b*); and a low-loss matching circuit (17) having its input connected to said asymmetrizing network (9) so as to produce a symmetrically received voltage (Us) at its output (11*a*).

35. The antenna according to claim 33, wherein said asymmetric voltage (~Uu) is injected or drawn at said connecting gate (Tu) for the additional transmission or reception operation during omnidirectional radiation with vertical polarization.

36. An antenna for mobile satellite communication disposed on a substantially horizontally oriented conductive base surface (1) for providing circular polarization comprising:

two identical antennas disposed in intersecting planes with antenna connection points (T1*a*, T1*b* and T2*a*, T2*b*) at each end, and having substantially linear conductor parts (4*a*) disposed in orthogonal planes (0) with respect to the base surface (1) and having impedances (7) connected in series therewith;

a vertical antenna conductor (20) coupled to the intersection and symmetry point (12) of said two antennas and having a central antenna connection point (Tu);

at least one asymmetrizing network (9) having its inputs connected to the antenna connection points (T1*a*, T1*b* and T2*a*, T2*b*);

at least one matching circuit (17) coupled to the output of said at least one asymmetrizing network (9) for producing at its output a symmetrical voltage (Us); and, a matching network (29) coupled to said central connection point (Tu) for producing at its output an asymmetrical voltage (Uu) so that in the event of a frequency difference of the frequencies of the symmetrical and asymmetrical voltages (Us, Uu), the decoupling between the symmetrical voltage outputs which is limited due to the residual asymmetry of the network is improved by frequency selective adjustment of said matching network (29) and said matching circuit (17).

37. The antenna according to claim 36, wherein in the event of discontinuities in the conductive base surface (1) or changes in the inclination thereof relative to the horizontal so as to cause a deviation from the symmetry of the existing antenna arrangement, appropriate different values are selected for said impedances (7) mounted in the individual conductor parts in order to compensate for the resulting perturbation of the directional diagram of the antenna.

* * * * *